US010573280B2

(12) United States Patent
Nesbitt

(10) Patent No.: US 10,573,280 B2
(45) Date of Patent: Feb. 25, 2020

(54) MARKED PRECOATED STRINGS AND METHOD OF MANUFACTURING SAME

(71) Applicant: Innovatech, LLC, Chicago, IL (US)

(72) Inventor: Bruce Nesbitt, Chicago, IL (US)

(73) Assignee: Innovatech, LLC, Chicago, IL (US)

( * ) Notice: Subject to any disclaimer, the term of this patent is extended or adjusted under 35 U.S.C. 154(b) by 132 days.

(21) Appl. No.: 15/147,572

(22) Filed: May 5, 2016

(65) Prior Publication Data

US 2016/0247491 A1 Aug. 25, 2016

Related U.S. Application Data

(60) Division of application No. 14/322,255, filed on Jul. 2, 2014, now Pat. No. 9,355,621, which is a division of application No. 13/743,094, filed on Jan. 16, 2013, now Pat. No. 8,772,614, which is a continuation of application No. 13/040,829, filed on Mar. 4, 2011, now Pat. No. 8,362,344, which is a continuation of application No. 12/766,426, filed on Apr. 23, 2010, now Pat. No. 7,923,617, which is a continuation of application No. 12/211,630, filed on Sep. 16, 2008, now Pat. No. 7,714,217, which is a continuation-in-part of application No. 12/171,847, (Continued)

(51) Int. Cl.
*G10D 3/10* (2006.01)
*B05D 3/00* (2006.01)

(52) U.S. Cl.
CPC ..... *G10D 3/10* (2013.01); *B05D 3/007* (2013.01)

(58) Field of Classification Search
CPC ..... G10D 3/10; B05D 3/007
USPC ..... 84/297 S
See application file for complete search history.

(56) References Cited

U.S. PATENT DOCUMENTS 1,617,102 A 2/1927 Cohn
1,772,846 A 8/1930 Spolidoro
(Continued)

FOREIGN PATENT DOCUMENTS

EP 0 321 091 6/1989
EP 0 624 380 11/1994
(Continued)

OTHER PUBLICATIONS

Acetal (POM) Engineering Property Data, Article, published by Material Property Data, [online] [retrieved from the Internet Nov. 26, 2007] <URL:www.matweb.com/reference/acetalpolymer.aspx>.

(Continued)

*Primary Examiner* — Jiachun Qin
(74) *Attorney, Agent, or Firm* — Neal, Gerber & Eisenberg LLP

(57) ABSTRACT

A coated string for a stringed device which includes a coating applied to the surface of the string. The coating includes a base layer bonded to the surface of the string and an at least partially transparent low-friction top coat applied to the base layer. The base layer includes heat activated pigments that change color when heated above a color shifting temperature. In one embodiment, the color of the pigment in one area contrasts with the color of the pigment in an adjacent area without otherwise affecting the low-friction surface of the coating. The areas of different color created in locations along the length of the low-friction coated string.

24 Claims, 10 Drawing Sheets

Related U.S. Application Data filed on Jul. 11, 2008, now Pat. No. 8,231,926, which is a continuation-in-part of application No. 11/962,326, filed on Dec. 21, 2007, now Pat. No. 8,048,471.

(56) References Cited

U.S. PATENT DOCUMENTS 2,049,769 A 8/1936 Gray
2,241,282 A 5/1941 Wackerle
2,241,283 A 5/1941 Wackerle
2,735,258 A 2/1956 Crandall
2,861,417 A 11/1958 Crandall
2,892,374 A 6/1959 Ralls, Jr.
3,085,912 A 4/1963 Friese
3,099,595 A 7/1963 Allbaugh
3,120,144 A 2/1964 Bayer
3,218,904 A 11/1965 Hartman
3,706,883 A 12/1972 McIntyre
3,771,409 A 11/1973 Rickey
3,812,842 A 5/1974 Rodriguez
3,820,434 A 6/1974 Roberts
3,845,686 A 11/1974 Salvo
3,857,934 A 12/1974 Bernstein et al.
3,968,288 A * 7/1976 Trexler ..... B05D 3/12 427/194
3,978,756 A 9/1976 Feldman
4,003,369 A 1/1977 Heilman et al.
4,008,351 A 2/1977 Inoue et al.
4,016,714 A 4/1977 Crandall, Jr.
4,080,706 A 3/1978 Heilman et al.
4,120,146 A 10/1978 Robin
4,291,606 A 9/1981 Lepage
4,336,087 A 6/1982 Martuch et al.
4,377,620 A 3/1983 Alexander
4,382,358 A 5/1983 Tappe et al.
4,539,228 A 9/1985 Lazarus
4,540,628 A 9/1985 Oberdeck et al.
4,559,861 A 12/1985 Patty
4,570,170 A 2/1986 Hiraishi et al.
4,577,637 A 3/1986 Mueller, Jr.
4,645,491 A 2/1987 Evans
4,712,464 A 12/1987 Nance
4,724,846 A 2/1988 Evans, III
4,779,628 A 10/1988 Machek
4,791,848 A 12/1988 Blum, Jr.
4,796,637 A 1/1989 Mascuch et al.
4,799,496 A 1/1989 Hargreaves et al.
4,846,193 A 7/1989 Tremulis et al.
4,854,330 A 8/1989 Evans, III et al.
4,875,489 A 10/1989 Messner et al.
4,895,168 A 1/1990 Machek
4,922,923 A 5/1990 Gambale et al.
4,951,686 A 8/1990 Herlitze
4,966,163 A 10/1990 Kraus et al.
5,034,005 A 7/1991 Appling
5,038,458 A 8/1991 Wagoner et al.
5,063,935 A 11/1991 Gambale
5,084,022 A 1/1992 Claude
5,091,284 A 2/1992 Bradfield
5,107,852 A 4/1992 Davidson et al.
5,114,401 A 5/1992 Stuart et al.
5,117,838 A 6/1992 Palmer et al.
5,117,839 A 6/1992 Dance
5,144,959 A 9/1992 Gambale et al.
5,149,965 A 9/1992 Marks
5,154,705 A 10/1992 Fleischhacker et al.
5,165,013 A 11/1992 Faris
5,165,421 A 11/1992 Fleischhacker et al.
5,174,302 A 12/1992 Palmer
5,203,777 A 4/1993 Lee
5,211,636 A 5/1993 Mische
5,234,002 A 8/1993 Chan
5,241,970 A 9/1993 Johlin, Jr. et al.
5,243,996 A 9/1993 Hall
5,260,985 A 11/1993 Mosby
5,265,622 A 11/1993 Barbere
5,267,955 A 12/1993 Hanson
5,271,415 A 12/1993 Foerster et al.
5,273,526 A 12/1993 Dance et al.
5,279,546 A 1/1994 Mische et al.
5,279,573 A 1/1994 Klosterman
5,282,478 A 2/1994 Fleischhacker, Jr. et al.
5,300,048 A 4/1994 Drewes, Jr. et al.
5,345,945 A 9/1994 Hodgson et al.
5,353,808 A 10/1994 Viera
5,360,403 A 11/1994 Mische
5,373,619 A 12/1994 Fleischhacker et al.
5,376,083 A 12/1994 Mische
5,379,779 A 1/1995 Rowland et al.
5,409,004 A 4/1995 Sloan
5,433,200 A 7/1995 Fleischhacker, Jr.
5,443,081 A 8/1995 Klosterman
D363,544 S 10/1995 Rowland et al.
D363,776 S 10/1995 Rowland et al.
5,458,040 A 10/1995 Lawrence, Jr.
5,479,938 A 1/1996 Weier
5,497,783 A 3/1996 Urick et al.
5,497,786 A 3/1996 Urick
5,498,250 A 3/1996 Prather
5,501,827 A 3/1996 Deeney et al.
5,546,958 A 8/1996 Thorud et al.
5,551,444 A 9/1996 Finlayson
5,559,297 A 9/1996 Yoshikawa et al.
5,606,981 A 3/1997 Tartacower et al.
5,610,348 A 3/1997 Aladin et al.
5,619,778 A 4/1997 Sloot
5,634,897 A 6/1997 Dance et al.
5,638,589 A 6/1997 Phillips
5,640,970 A 6/1997 Arenas
5,665,103 A 9/1997 Lafontaine et al.
5,669,878 A 9/1997 Dickinson et al.
5,713,351 A 2/1998 Billings et al.
5,724,989 A 3/1998 Dobson
5,728,042 A 3/1998 Schwager
H1715 H 4/1998 Longeat
5,740,473 A 4/1998 Tanaka et al.
5,741,267 A 4/1998 Jorneus et al.
5,759,174 A 6/1998 Fischell et al.
5,782,811 A 7/1998 Samson et al.
5,801,319 A 9/1998 Hebestreit
5,804,633 A 9/1998 Loftin et al.
5,807,279 A 9/1998 Viera
5,830,155 A 11/1998 Frechette et al.
5,836,892 A 11/1998 Lorenzo
5,876,783 A 3/1999 Dobson
5,883,319 A 3/1999 Hebestreit
5,885,227 A 3/1999 Finlayson
5,897,819 A 4/1999 Miyata et al.
5,898,117 A 4/1999 Ishida
5,907,113 A 5/1999 Hebestreit
D410,671 S 6/1999 Aleksa
5,908,413 A 6/1999 Lange et al.
5,919,126 A 7/1999 Armini
5,919,170 A 7/1999 Woessner
5,920,023 A 7/1999 Ravagni et al.
5,941,706 A 8/1999 Ura
5,948,489 A 9/1999 Hopkins
5,970,119 A 10/1999 Hofmann
5,984,877 A 11/1999 Fleischhacker, Jr.
6,036,682 A 3/2000 Lange et al.
6,042,605 A 3/2000 Martin et al.
6,048,620 A 4/2000 Zhong
6,050,958 A 4/2000 Dickinson et al.
6,083,167 A 7/2000 Fox et al.
6,093,157 A 7/2000 Chandrasekaran
6,093,678 A 7/2000 Hamada et al.
6,113,576 A 9/2000 Dance et al.
6,139,540 A 10/2000 Rost et al.
6,143,013 A 11/2000 Samson et al.
6,168,570 B1 1/2001 Ferrera
6,179,788 B1 1/2001 Sullivan
6,193,706 B1 2/2001 Thorud et al.
6,211,450 B1 4/2001 Ishida
6,238,847 B1 5/2001 Axtell, III et al.
6,248,942 B1 6/2001 Hebestreit et al.

(56) References Cited

U.S. PATENT DOCUMENTS 6,273,858 B1 8/2001 Fox et al.
6,277,108 B1 8/2001 Mcbroom et al.
6,306,105 B1 10/2001 Rooney et al.
6,315,790 B1 11/2001 Gerberding et al.
6,340,368 B1 1/2002 Verbeck
6,348,646 B1 2/2002 Parker et al.
6,355,058 B1 3/2002 Pacetti et al.
6,361,557 B1 3/2002 Gittings et al.
6,370,304 B1 4/2002 Mills et al.
6,387,060 B1 5/2002 Jalisi
6,402,777 B1 6/2002 Globerman et al.
6,425,927 B1 7/2002 Haupt-Stephan et al.
6,428,512 B1 8/2002 Anderson
6,452,080 B1 9/2002 Coonce
6,468,079 B1 10/2002 Fischer et al.
6,475,169 B2 11/2002 Ferrera
6,491,646 B1 12/2002 Blackledge
6,501,992 B1 12/2002 Belden et al.
6,503,310 B1 1/2003 Sullivan
6,520,923 B1 2/2003 Jalisi
6,520,934 B1 2/2003 Lee et al.
6,528,709 B2 * 3/2003 Hebestreit ..... G10D 3/10 84/297 R
6,540,721 B1 4/2003 Voyles et al.
6,554,942 B2 4/2003 Solar et al.
6,605,049 B1 8/2003 Wagner et al.
6,612,998 B2 9/2003 Gosiengfiao et al.
6,613,002 B1 9/2003 Clark et al.
6,617,515 B1 9/2003 Yeung
6,620,114 B2 9/2003 Vrba et al.
6,623,504 B2 9/2003 Vrba et al.
6,626,869 B1 9/2003 Bint
6,635,082 B1 10/2003 Hossainy et al.
6,636,758 B2 10/2003 Sanchez et al.
6,652,568 B1 11/2003 Becker et al.
6,652,579 B1 11/2003 Cox et al.
6,673,025 B1 1/2004 Richardson et al.
6,679,853 B1 1/2004 Jalisi
6,680,121 B2 1/2004 Sakoske et al.
6,733,503 B2 5/2004 Layrolle et al.
6,765,136 B2 7/2004 Van Pamel
D496,728 S 9/2004 Holsinger
6,811,805 B2 * 11/2004 Gilliard ..... B29D 11/00317 427/164
6,811,958 B2 11/2004 Iwani et al.
6,835,454 B1 12/2004 Randa et al.
6,855,161 B2 2/2005 Boylan et al.
6,942,652 B1 9/2005 Pressly, Sr. et al.
6,994,883 B2 2/2006 Layrolle et al.
7,022,086 B2 4/2006 Her
7,033,325 B1 4/2006 Sullivan
7,147,634 B2 12/2006 Nesbitt
7,150,756 B2 12/2006 Levinson et al.
7,153,277 B2 12/2006 Skujins et al.
7,160,297 B2 * 1/2007 Nesbitt ..... A47J 36/025 427/180
7,163,509 B2 1/2007 Abe
7,182,757 B2 2/2007 Miyata et al.
7,217,876 B2 5/2007 Allen et al.
7,241,406 B2 7/2007 Solar et al.
7,255,685 B2 8/2007 Pressly, Sr. et al.
7,261,925 B2 8/2007 Nesbitt
7,278,973 B2 10/2007 Iwami et al.
7,288,091 B2 10/2007 Nesbitt
7,296,333 B2 11/2007 Jalisi
7,309,235 B2 12/2007 Wilk
7,311,714 B1 12/2007 Wascher
7,390,326 B2 6/2008 Nesbitt
7,399,296 B2 7/2008 Poole et al.
7,408,101 B2 8/2008 Shelton
7,410,665 B2 8/2008 Ragheb et al.
7,434,437 B2 10/2008 Kato et al.
7,455,646 B2 11/2008 Richardson et al.
7,458,941 B2 12/2008 Caillouette
7,473,417 B2 1/2009 Zeltinger et al.
7,517,342 B2 4/2009 Scott et al.
7,608,766 B2 10/2009 Shlesinger
7,714,217 B2 5/2010 Nesbitt
7,718,212 B2 5/2010 Nesbitt
7,811,623 B2 10/2010 Nesbitt
8,187,206 B2 5/2012 Kinoshita et al.
8,206,320 B2 6/2012 Deal et al.
8,292,872 B2 10/2012 Soetermans
2002/0087098 A1 7/2002 Iwami et al.
2003/0060731 A1 3/2003 Fleischhacker
2003/0060783 A1 3/2003 Koole et al.
2003/0060872 A1 3/2003 Gomringer et al.
2003/0109865 A1 6/2003 Greep et al.
2003/0120302 A1 6/2003 Minck, Jr. et al.
2003/0121394 A1 7/2003 Hebestreit et al.
2003/0139764 A1 7/2003 Levinson et al.
2003/0190478 A1 10/2003 Kutsuna et al.
2003/0196538 A1 10/2003 Katchnov et al.
2003/0199759 A1 10/2003 Richard
2003/0203991 A1 10/2003 Schottman et al.
2003/0216642 A1 11/2003 Pepin et al.
2003/0229298 A1 12/2003 Iwami et al.
2004/0044399 A1 3/2004 Ventura
2004/0099124 A1 5/2004 Deverich
2004/0122509 A1 6/2004 Brodeur
2004/0220608 A1 11/2004 D'aquanni et al.
2004/0253185 A1 12/2004 Herweck et al.
2004/0255751 A1 12/2004 Schlesinger
2004/0267161 A1 12/2004 Osborne et al.
2005/0003103 A1 1/2005 Krupa
2005/0011332 A1 1/2005 Dronge
2005/0013842 A1 1/2005 Qiu et al.
2005/0038500 A1 2/2005 Boylan et al.
2005/0070821 A1 3/2005 Deal et al.
2005/0080358 A1 4/2005 Iwami et al.
2005/0087520 A1 4/2005 Wang et al.
2005/0133941 A1 6/2005 Schuhmacher
2005/0148902 A1 7/2005 Minar et al.
2005/0154075 A1 7/2005 Siegel
2005/0165472 A1 7/2005 Glocker
2005/0187466 A1 8/2005 Glocker et al.
2005/0261670 A1 11/2005 Weber et al.
2005/0274055 A1 * 12/2005 Cook ..... A01K 85/00 43/44.98
2005/0288773 A1 12/2005 Glocker et al.
2006/0036316 A1 2/2006 Zetinger et al.
2006/0073264 A1 * 4/2006 Sakane ..... A61L 31/022 427/2.1
2006/0101979 A1 5/2006 Shelton
2006/0118612 A1 6/2006 Christoffersen et al.
2006/0149165 A1 7/2006 Kennedy et al.
2006/0174745 A1 8/2006 D'Addario
2006/0174746 A1 8/2006 Everly
2006/0184112 A1 8/2006 Horn et al.
2006/0211952 A1 9/2006 Kennedy, II
2006/0257653 A1 11/2006 Tsujimoto et al.
2006/0259033 A1 11/2006 Nesbitt
2006/0271135 A1 11/2006 Minar et al.
2006/0276910 A1 12/2006 Weber
2007/0017334 A1 1/2007 Hebestreit et al.
2007/0021811 A1 1/2007 D'aquanni et al.
2007/0043333 A1 2/2007 Kampa et al.
2007/0093811 A1 4/2007 Nesbitt
2007/0100279 A1 5/2007 Bates
2007/0118113 A1 5/2007 Nesbitt
2007/0178133 A1 8/2007 Rolland
2007/0207182 A1 9/2007 Weber et al.
2007/0208373 A1 9/2007 Zaver et al.
2007/0212547 A1 9/2007 Fredrickson et al.
2007/0255189 A1 11/2007 Halanski et al.
2007/0266542 A1 11/2007 Melsheimer
2008/0008654 A1 1/2008 Clarke et al.
2008/0027532 A1 1/2008 Boylan et al.
2008/0032060 A1 2/2008 Nesbitt
2008/0033373 A1 2/2008 Koole et al.
2008/0050509 A1 2/2008 Nesbitt
2008/0108974 A1 5/2008 Yee Roth et al.
2008/0181969 A1 7/2008 Blanton et al.
2008/0228109 A1 9/2008 Kinoshita et al.

(56) References Cited

U.S. PATENT DOCUMENTS

| | | | |
|---|---|---|---|
| 2008/0288056 | A1 | 11/2008 | Simpson et al. |
| 2009/0158912 | A1 | 6/2009 | Nesbitt |
| 2009/0162530 | A1 | 6/2009 | Nesbitt |
| 2009/0162531 | A1 | 6/2009 | Nesbitt |
| 2009/0163833 | A1 | 6/2009 | Kinoshita et al. |
| 2009/0181156 | A1 | 7/2009 | Nesbitt et al. |
| 2009/0211909 | A1 | 8/2009 | Nesbitt |
| 2009/0258984 | A1 | 10/2009 | Sandford et al. |
| 2010/0160486 | A1 | 6/2010 | Blanton et al. |
| 2010/0199830 | A1 | 8/2010 | Nesbitt |

FOREIGN PATENT DOCUMENTS

| | | | | |
|---|---|---|---|---|
| EP | 0 771 572 | | | 5/1997 |
| EP | 0 832 664 | | | 4/1998 |
| EP | 0 987 042 | | | 3/2000 |
| EP | 0 749 334 | | | 6/2000 |
| EP | 1 025 811 | | | 8/2000 |
| EP | 1 062 965 | | | 12/2000 |
| EP | 0 833 676 | | | 9/2003 |
| EP | 1 433 438 | | | 6/2004 |
| JP | 07290660 | A | * | 11/1995 |
| WO | WO/1995/014501 | | | 6/1995 |
| WO | WO/2001/045592 | | | 6/2001 |
| WO | WO/2002/047549 | | | 6/2002 |
| WO | WO/2004/033016 | | | 4/2004 |
| WO | WO 2004/049970 | | | 6/2004 |
| WO | WO/2004/110519 | | | 12/2004 |
| WO | WO/2005/094486 | | | 10/2005 |
| WO | WO/2005/122961 | | | 12/2005 |
| WO | WO/2006/002199 | | | 1/2006 |
| WO | WO 2006/019983 | | | 2/2006 |
| WO | WO/2007/100556 | | | 9/2007 |
| WO | WO/2008/097359 | | | 8/2008 |

OTHER PUBLICATIONS

Advancements in Laser Marking of Plastics, Article, published by the Sabreen Group, Inc., prior to Sep. 2008.

ClearClad: "Electrophoretic Coating", pp. 1-4, 1996-2002.

Guitar strings get Gore-Tex treatment, Article, published by the Gannett News Service, Jan. 28, 1997.

Hydrophilic Coatings, Product Leaflet, published by MCTec, [online] [retrieved from the Internet Nov. 2, 2008] <URL:www.mctecbv.com>.

International Search Report and the Written Opinion of the International Searching Authority, dated Jun. 22, 2009, for PCT/US09/42697.

Marking Processes for Use in Harsh Environments, Article, published by the Sabreen Group, Inc., [online] [retrieved from the Internet Nov. 26, 2007] <URL:www.plasticslasermarking.com/laser_marking_harsh_environments.htm>.

Nagaoka et al., "Low Friction Hydrophillic Surface for medical Device", BioMaterials, Aug. 11, 1990, pp. 419-424.

Office Action of U.S. Appl. No. 12/211,630 dated Aug. 18, 2009.

Office Action for U.S. Appl. No. 12/402,218 dated Dec. 23, 2009.

Office Action for U.S. Appl. No. 13/535,009, dated Feb. 28, 2013.

Office Action for U.S. Appl. No. 13/541,010, dated Mar. 20, 2013.

Office Action of U.S. Appl. No. 11/962,326 dated Oct. 20, 2009.

Plastics Laser Marking in the Aerospace Industry, Article, published by the Sabreen Group, Inc., [online] [retrieved from the Internet Nov. 26, 2007] <URL:www.plasticslasermarking.com/laser_marking_aerospace.htm>.

Sabreen, Scott R., New Technologies for High-Speed Color Laser Marking of Plastics, Article, published by Plastics Decorating Magazine, Oct./Nov. 2004.

Total solutions for High Contrast & Color Laser Marking, Article, Published by the Sabreen Group, Inc., [online] [retrieved from the Internet Nov. 26, 2007] <URL:www.plasticslasermarking.com/metals_laser_marking.htm>.

Total Solutions for High Contrast Laser Marking of Plastics and Metals Substrates, Article, published by the Sabreen Group, Inc., [online] [retrieved from the Internet Nov. 26, 2007] <URL:www.plasticslasermarking.com/laser_marking.htm>.

UV40 Dual Care Acrylated Urethane Coating Technical Data Sheet: Chase Specialty Coatings, pp. 1-3, Jul. 2007.

* cited by examiner

MARKED PRECOATED STRINGS AND METHOD OF MANUFACTURING SAME

PRIORITY CLAIM

This application is a divisional of, claims priority to and the benefit of U.S. patent application Ser. No. 14/322,255, filed on Jul. 2, 2014, now U.S. Pat. No. 9,355,621, which is a divisional of, claims priority to and the benefit of U.S. patent application Ser. No. 13/743,094, filed on Jan. 16, 2013, now U.S. Pat. No. 8,772,614, which is a continuation of, claims priority to and the benefit of U.S. patent application Ser. No. 13/040,829, filed on Mar. 4, 2011, now U.S. Pat. No. 8,362,344, which is a continuation of, claims priority to and the benefit of U.S. patent application Ser. No. 12/766,426, filed on Apr. 23, 2010, now U.S. Pat. No. 7,923,617, which is a continuation of, claims priority to and the benefit of U.S. patent application Ser. No. 12/211,630, filed on Sep. 16, 2008, now U.S. Pat. No. 7,714,217, which is a continuation-in-part of, claims priority to and the benefit of U.S. patent application Ser. No. 12/171,847, filed on Jul. 11, 2008, now U.S. Pat. No. 8,231,926, which is a continuation-in-part of, claims priority to and the benefit of U.S. patent application Ser. No. 11/962,326, filed on Dec. 21, 2007, now U.S. Pat. No. 8,048,471, the entire contents of which are each incorporated by reference herein.

CROSS REFERENCE TO RELATED APPLICATIONS

This application is related to the following commonly-owned U.S. Patent: "MARKED PRECOATED MEDICAL DEVICE AND METHOD OF MANUFACTURING SAME," U.S. Pat. No. 8,940,357.

BACKGROUND

Many different types or classes of musical instruments are known. One known type or class of musical instruments are string instruments. String instruments typically include one or more strings which, when contacted or touched, vibrate to create sounds or musical notes. Different types of known musical strings perform different functions. Various known stringed musical instruments employ a single or individual wired string (or a plurality of single or individual wired strings of different diameters) to produce higher pitched sounds. Another known stringed musical instrument employs a wound string (i.e., a central wire core with one or more separate wires wound around the central wire core) to produce lower pitched sounds. Wound strings rely on the additional string mass per unit length provided by the spiral wrap of the wound string to supply lower pitched notes at an acceptable string tension.

Certain known stringed musical instruments require human digital contact, human hand(s) contact, and/or contact with a musical instrument accessory (e.g., a pick or a bow) along one or more designated portions of the strings. These strings and specifically these wound strings tend to become contaminated with dirt, skin oils, bodily salts, bodily acids and perspiration after even a few hours of contact or playing. Such dirt and other contaminants infiltrate windings of the string causing the windings to gradually have less, restricted or limited motion which can change the sound quality (i.e., the pitch and/or the tone) of such musical strings. After a relatively short period of time, such strings often become musically "dead," apparently due to the build-up of such contamination outside of the strings and additionally inside the windings of the wound strings. Wound strings that lose their sound quality must be adjusted (to maintain their sound quality) which is burdensome and time consuming for musicians. Moreover, after a period of time, such strings that lose their sound quality must be removed from the instrument because they cannot be effectively cleaned. This process is burdensome, time consuming, and expensive for musicians who play frequently and are very concerned about sound quality.

Another known problem with conventional musical strings, and particularly conventional wound musical strings, is that the action of fingering quickly up and down the strings often generates unwanted or unintended noises. For instance, it is common to hear a "squeak" from a guitar string, a bass string, a cello string and other wound strings as the musician's fingers rapidly move up and down a fret board or finger board. To avoid such unwanted or unintended noises, certain musicians often make concerted efforts to completely separate their fingers from the strings when repositioning pressure on the strings along the fret board or finger board. This repositioning action slows the musical note changes and further increases both physical fatigue and mental fatigue. Moreover, to avoid such unwanted or unintended noises, certain musicians use "flat-wound" strings (i.e., square or rectangular wire wound over the core wire) or "groundwound" strings (i.e., round wire that have been partially ground smooth after winding over the core wire). However, such strings have an increased costs and do not entirely eliminate such unwanted or unintended noises.

Another known problem encountered with strings requiring fingering along a fret board or finger board (e.g., a guitar fret board) is that a substantial amount of pressure must often be applied by the musician against the fret board or finger board to produce different musical notes. This can be discouraging for beginning music students. Accomplished musicians often develop extensive calluses on their fingers from years of playing their instruments. Despite such calluses, the pressure and friction generated by playing the instruments tends to be one of the primary causes of frustration, fatigue and sometimes injury for many musicians.

Moreover, in the case of metal musical strings, the metal-to-metal contact between the frets or protrusions from the neck of the stringed instrument and the metal musical strings often causes wear to both the string and the underlying protrusion or fret. This wear can change the sound quality of such musical strings and expedite the need to replace such strings and/or the fret boards or adjust the string position after any fret board replacement.

Another problem with stringed musical instruments is that beginning music students are unaware of the exact location or range of locations at which to place their fingers on each of the separate strings to produce a certain musical note. Additionally, many beginning music students are unaware of which exact string(s) to apply pressure to produce a certain musical note. Musical instrument strings of uniform color and/or non-distinctive color do not provide any indication of the exact string to choose nor do such strings provide any indication of which finger locations on the string correspond to which music notes the musician wants to play.

Accordingly, a need exists for improved musical strings for stringed musical instruments.

SUMMARY

The present disclosure relates in general to coated strings for stringed devices, stringed devices which include one or more coated strings and a method for manufacturing the same. In various embodiments, such coated strings are generally described herein as coated musical strings and such stringed devices are generally described herein as musical instruments including one or more coated musical strings.

In various embodiments, the present disclosure relates to a musical string including a coating applied to the outer surface(s) and/or inner surface(s) of wound musical strings. The coating includes a base layer (including one or more colored pigments) bonded to the surface of the musical string and an at least partially low-friction top coat on the base layer. Such a coated musical string thus includes one or more low friction, low surface energy, non-stick and/or corrosion resistant coatings which prolong the ability for the musical string to maintain the frequency at which it vibrates and do not adversely affect the sounds produced by such a musical string.

In one embodiment, the musical string is generally elongated and has a first, distal or adjustable end (i.e., the end of the musical string adjustably attachable to the musical instrument at which the tautness of the musical string can be adjusted with an adjustable mechanism), a second, proximal or attachable end (i.e., the end of the musical string statically attached to the musical instrument), and an outer surface. In one such embodiment, the musical string is straight or unwound and includes one or more monofilament or multifilament strands of a metal wire.

In another embodiment, the musical string is generally elongated and has a first, distal or adjustable end, a second, proximal or attachable end, an outer surface and one or more inner surfaces. In one such embodiment, the musical string is wound and includes one or more monofilament or multifilament strands of a metal wire around which additional monofilament or multifilament strands of wire are wound or braided. It should be appreciated that various different dimensioned musical strings and various different types and configurations of musical strings may be coated with one or more of the coatings described herein.

In different embodiments, the musical string may be made of natural or synthetic materials or combinations of natural and synthetic materials. In one such embodiment, one or more polymers, polyamides, such as nylon, or synthetic polymers may be used as a single string or as a central strand. In another embodiment, the natural product called "gut" (which is derived from animal sources) is used for the musical strings disclosed herein. In different embodiments, composite strings, metal strings and strings made of any suitable material or combination of materials may be used in certain applications of the musical strings disclosed herein.

In one embodiment, a coating is applied to the outer surface(s) of a musical string. In different embodiments, the coating applied to the outer surface of the musical string includes a binder resin (such as any epoxy, polyimide, polyamide, polyetheretherketone (PEEK), polyetherketone (PEK) and/or polyarylsulfone), and one or more suitable pigments (such as any suitable heat activated pigment, organic pigment, inorganic pigment, extender pigment, magnetic receptive pigment, and/or laser excitable pigment). In various embodiments, the above-mentioned binder or matrix coating also includes particles of a low friction and/or low surface energy material (such as PTFE, fluorinated ethylene propylene (FEP), polyethylene (PE), perfluoroalkoxy (PFA), tetrafluoroethylene perfluoromethyl vinyl ether copolymer (MFA), PEEK, PEK, PEK graphite, silicone particles, ceramic particles, and/or carbon particles).

In one embodiment, after the coating is applied to the outer surface(s) of the musical string, the musical string and the applied coating are heated above a designated temperature, such as 500° F. (260° C.), for a designated period of time to cure the coating. During this curing process, the low-friction particles soften and at least some of the low-friction material migrates or flows to the surface of the coating. At or near the surface of the coating, the low-friction material fuses or glazes over the base layer to create a smooth, substantially continuous top coat comprised of low-friction material. Also during this curing process, the binder material binds with the surface of the musical string and the pigment is left interspersed within the binder material. When curing is complete, the musical string coating includes a base layer including a binder material and a pigment, and an at least partially transparent or translucent top coat substantially comprised of low friction or low surface energy materials (which may be suitably textured due to larger particles that protrude thru the base layer). Accordingly, this embodiment provides a musical string with a transparent, partially transparent or translucent low-friction top coat which is situated above a plurality of pigments and binder or matrix resins.

In one embodiment, after the initial or first curing of the specific coating on the surface of the musical string, markings within the coating are created by selectively heating or by otherwise selectively applying an external energy source to portions of the coating (which include a heat activated pigment) to cause such pigments to change or shift colors. For example, using a jet of hot air, open flame, or other suitable mechanism or apparatus for applying heat, the color of a small length of the musical string in a first location is shifted such that the musical string has a band of different color around its circumference. In such an embodiment, the binder resin and pigment are generally stable at the first curing temperature such that the color shifting temperature must be greater than the first curing temperature to ensure that the pigment does not shift or change color during the first curing process. The color shifting temperature must also be less than the temperatures at which either the binder material significantly loses its adhesion to the surface of the musical string, or the low-friction material of the coating substantially degrades. That is, if the color shifting temperature is too high, then the low-friction character of the top coat will degrade (nullifying the effectiveness of the low-friction coating), and the binder material will lose adhesion to the surface of the musical string (causing the coating to deteriorate, delaminate or peel off) before the pigment can be heated above the color shifting temperature.

Accordingly, in this embodiment, a proper color shifting temperature enables the color of one or more of the pigments to shift to create areas of different or contrasting color after the first curing without substantially affecting, degrading, deteriorating, compromising or changing the chemical composition of the low-friction material of the coating and/or affecting, degrading, deteriorating, compromising or changing one or more characteristics, functions, or properties of the low-friction material of the coating. In this embodiment, a proper color shifting temperature also enables the color of one or more of the pigments to shift to create areas of different or contrasting color after the first curing without substantially affecting, degrading, deteriorating, compromising or changing one or more characteristics, properties, or functions of the adherence of the coating to the surface of the musical string. Therefore, a proper color shifting temperature enables markings to be created on the coated musical string without adversely affecting the function of the musical string or the coating thereon.

In one example embodiment, a first area of the low-friction coating is heated or activated to the color shifting temperature to shift or change the color of the heat activated pigment for a specific distance. In this embodiment, a distance is then measured from the first area to a second area. The second area is subsequently heated to the color shifting temperature to shift or change the color of the heat activated pigment.

In one embodiment, creating areas of shifted color on one or more coated strings can result in specific markings, such as a company logo or a musical band name, displayed on the coated musical strings disclosed herein. In another embodiment, creating areas of shifted color on one or more coated strings can result in specific markings displayed on the coated musical strings, such as indications of where a musician should place their fingers at designated locations to play a specific musical note. In one such embodiment, each of the musical strings of a stringed instrument is coated with a different color (which can include different shades of a color) which are created by heating the musical strings at different heat ranges. In this embodiment, a beginning student can quickly identify the exact string by the specific color of that string. In another embodiment, creating areas of shifted color on one or more coated strings can result in decorative color markings which different musicians may use to distinguish themselves from other musicians. Accordingly, the coated musical string and method disclosed herein provides specific markings that do not significantly increase or decrease the diameter of the musical string, do not significantly adversely affect the function of the low-friction coating and do not significantly adversely affect the sound quality produced by such musical strings.

In another embodiment, a plurality of anti-microbial particles are applied to or otherwise incorporated into one or more of the surfaces of the coated musical string to reduce and kill bacteria and other potential germs that are located on the surface(s) of the coated musical string, within the interstices of the wound constructions of a wound string or otherwise incorporated into the coating formulation. In this embodiment, the anti-microbial particles are capable of killing bacteria, pathogens and other harmful organisms which contact the surface of the coated musical string while in storage or while the coated musical string is in use.

Additional features and advantages are described herein, and will be apparent from, the following Detailed Description and the figures.

DETAILED DESCRIPTION

In different embodiments, the coated musical string disclosed herein may be utilized in any suitable stringed musical instrument utilized in the music industry, whether by an amateur musician or a professional musician, including, but not limited to: guitars, basses, banjos, violins, violas, cellos, mouth organs, zithers, sitars, harps, and mandolins. In different embodiments, the musical string can be constructed from any suitable material, including but not limited to: natural materials, synthetic materials, combinations of natural and synthetic materials. In different embodiments, the musical strings are constructed from nylon, nylon/polyamides, non-metallic composite materials or metals such as steel (both high-carbon and low-carbon content), stainless steel, aluminum, titanium, copper, nickel, silver, nitinol, and other metals and metal alloys and any combination thereof. In different embodiments, the musical strings are constructed from glass, ceramics, rubber, any suitable polymer material and any suitable plastic, including but not limited to: nylon, polyetheretherketone (PEEK), polyetherketone (PEK), polyphenylenesulphide (PPS), acrylonitrile-butadiene-styrene (ABS), polycarbonate, epoxy, polyester, and phenolic, or any combination thereof.

Figure 1A:
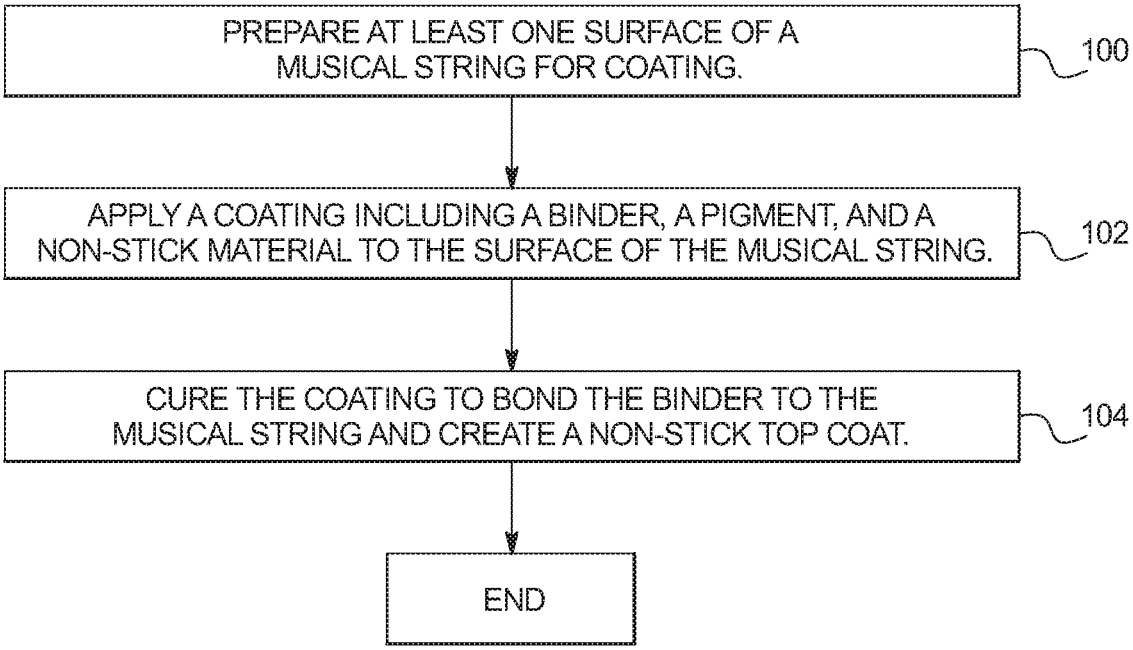
FIG. 1A is a flow chart describing one embodiment of the disclosed method of coating a musical string.
Figure 1B:
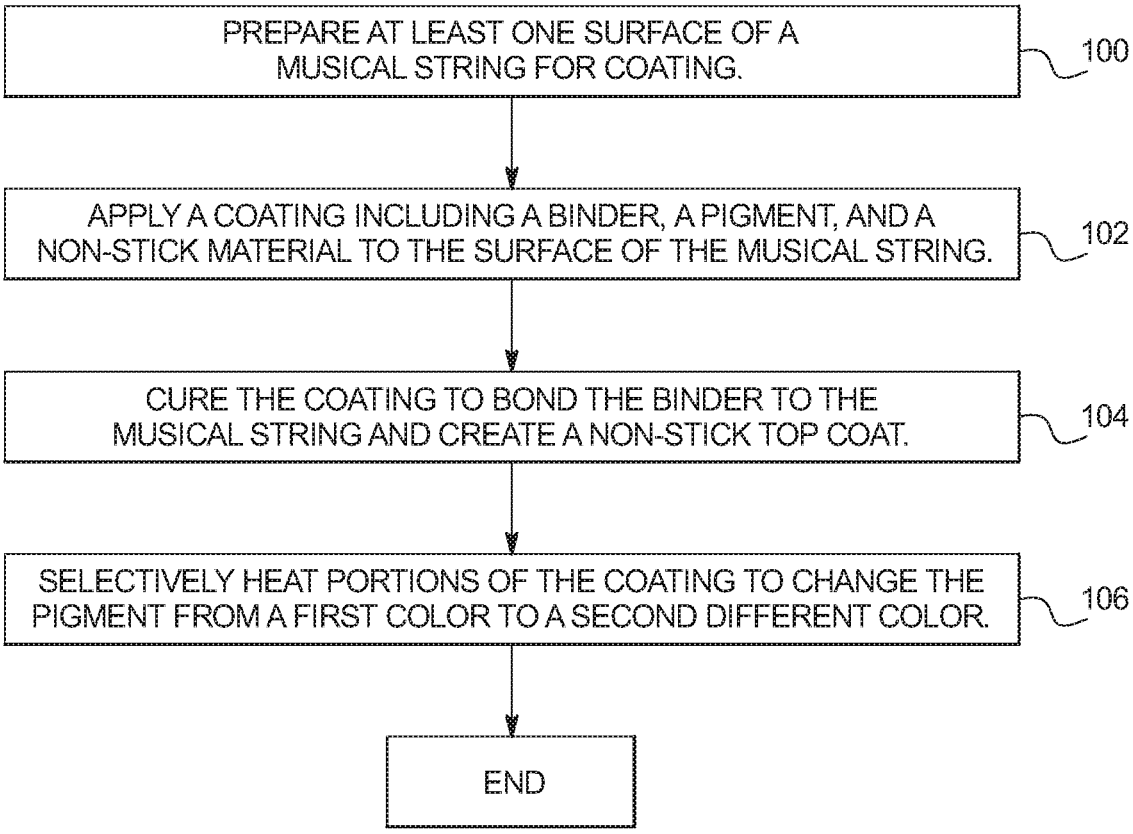
FIG. 1B is a flow chart describing one embodiment of the disclosed method of coating and marking a musical string.
Figure 2:
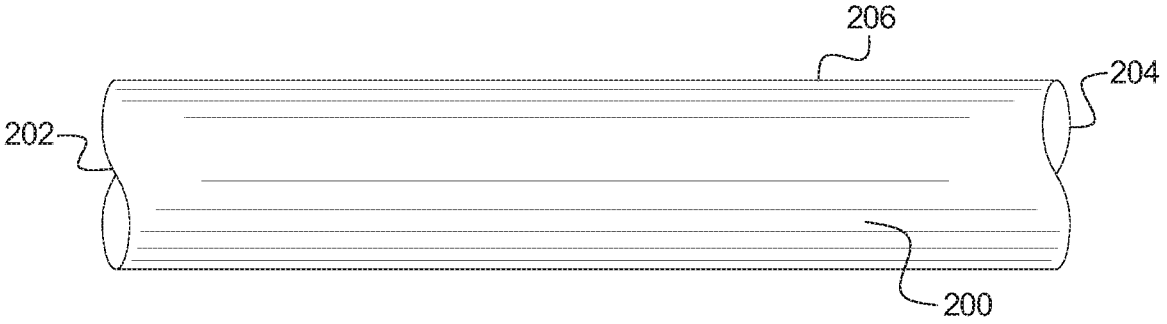
FIG. 2 is a side view of one embodiment of a segment of an uncoated musical string disclosed herein.

In one embodiment, before applying a coating to the outer surface(s) of the musical string, the musical string is prepared for coating as indicated in block 100 of FIGS. 1A and 1B. As seen in FIG. 2, before having a coating applied thereto, the musical string 200 is generally elongated and has a distal or adjustable end 202, a proximal or attached end 204, and an outer surface 206.

In one embodiment, to prepare the musical string for coating, the musical string is cleaned with a cleaner to remove impurities which are present on the surface of the musical string. Impurities such as oils may impede bonding of a coating to the surface of the musical string. The cleaner, such as a solvent, acid solution or alkaline, is manually applied, mechanically applied or ultrasonically applied to the musical string. In one embodiment, the musical string is cleaned by condensing a heated and vaporized cleaner on the surface of the musical string, wherein the cleaner dissolves and washes away the oils on the surface of the musical string. In another embodiment, grit blasting, tumble blasting, or sandblasting with a medium such as aluminum oxide, garnet, or silicone carbide is used to clean the surface of the musical string and create a roughened surface which promotes bonding with a coating. In another embodiment, the surface of the musical string is etched with acid or alkaline to clean and roughen the surface of the musical string followed by a suitable neutralization procedure. In another embodiment, a chemical phosphate type bath is used to deposit a relatively thin (e.g., such as 3 microns or in a range of 3 to 13 microns) bonding layer to the surface of the musical string. In another embodiment, a silane coupling agent is used to leave the proper amount of bonding agent molecules on the surface of the musical string prior to the application of the coating described herein. In another embodiment, a silane coupling agent is employed in combination with the liquid cleaning agents disclosed herein. In this embodiment, when the solvent or liquid cleaning agents evaporate, the silane coupling agent remains on the surface of the musical string (and within the winding surfaces of the wound musical strings). Such remaining silane coupling agent provides a primer that enhances adhesion of the coatings disclosed herein (without the optional roughening the surface of the musical string). In another embodiment, the musical string is cleaned with an ultrasonic cleaner used in combination with a solvent such as acetone or another degreaser. It should be appreciated that in another embodiment, subsequent to the liquid cleaning processes described above, a vacuum or vacuum heated system is employed to remove any excess liquid materials that may be within the coils, interior spaces or interstices of wire under the outer surface of a wound musical string.

In another embodiment, to prepare the musical string for coating, the musical string is pre-cleaned or the method is performed in a "clean room" where the cleaned part is manufactured and the step is not necessary. In another embodiment, the musical string is heated to a temperature, depending on the metal alloy or other material of the musical string, in excess of approximately 500° F. (260° C.) to 700° F. (371° C.) for a period of time sufficient to thermally degrade surface impurities, draw oils and other impurities out of any pores in the surface of the musical string and create a non-acidic "passivation" of the surface of the musical string (depending on any metal alloy of the musical string). In another embodiment, the musical string is cleaned in a batch or bulk cleaning method, thereby cleaning all of the surfaces of the musical string. In another embodiment, the musical string is heated before applying a coating to reduce ambient moisture on the surface of the musical string and improve adhesion of a coating to the musical string. In another embodiment, the musical string is cleaned with a grit-blasting system which includes several grit-blasting nozzles cleaning the surface of the musical string with relatively high velocity particles of an abrasive such as aluminum oxide or silicon carbide. In other embodiments, any combination of the cleaning methods mentioned above are used to improve the cleaning process and promote adhesion of a coating to the musical string.

Figure 3:
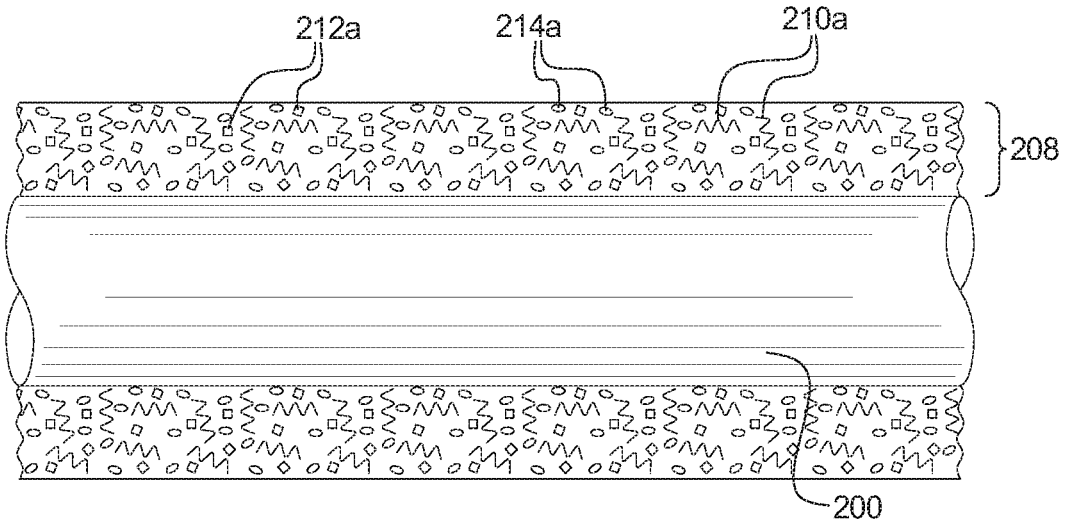
FIG. 3 is a side view, partially in section, of the musical string of FIG. 2 including an uncured coating applied to the surface thereof.

After preparing the musical string for coating, a coating is applied to one or more surfaces of the musical string as indicated in block 102 of FIGS. 1A and 1B. As seen in FIG. 3, one embodiment of the musical string is illustrated wherein the musical string includes an uncured coating 208 applied to its surface.

In one embodiment, as illustrated in FIG. 3, the coating includes a binder material 210*a*, such as an epoxy, phenolic, phenoxy, polyimide, polyamide, polyamide-amide, polyphenylene sulfide, polyarylsulfone, polyethylene, polytetrafluoroethylene, fluorinated ethylene propylene, ethylene chlorotrifluoroethlyene (ECTFE), ethylene tetrafluoroethylene (ETFE), perfluoroalkoxy, PEEK, PEK or any suitable binder or resin. Such suitable binders include any binder which, when cured, adheres to the surface of the musical string, and is flexible, stable, resistant to chemicals, and/or is readily sterilized and resistant to contamination. In one embodiment, the coating includes an ultraviolet light cure resin to semi or fully cure the coating. In another embodiment, the coating includes an electron beam cure resin.

In one embodiment, as illustrated in FIG. 3, the coating also includes at least one pigment 212*a* such as any suitable organic pigment, inorganic pigment, extender pigment, magnetic receptive pigment and/or laser excitable pigments. The organic pigments (with low to moderate heat resistance and which are represented as bright colors) include, but are not limited to: phthalocyanine blues and greens, diarylide yellows and oranges, quanacridone, naphthol and toluidine reds, and carbizole violets. The inorganic pigments (with moderate to high temperature resistance and which are represented as dull to moderately bright colors) include, but are not limited to: iron oxide reds and yellows, chrome oxide greens, titanium oxide white, cadmium reds, ultramarine blues, moly oranges, lead chromate yellows, and mixed metal oxides of various shades of brown, yellow, blue, green and black, carbon pigments, such as carbon black, graphite/carbon pigments and graphite pigments. The extender pigments (which are inorganic and provide a reinforcing/strengthening function) include, but are not limited to: talc, calcium carbonate, silicate and sulfate, silica, mica, aluminum hydrate and silicate, and barium sulfate (blanc fixe/barites). The laser exciteable pigments (which are excited by laser energy), such as near-infrared reflective pigments include, but are not limited to: mica, pearl pigment, Kaolin and aluminum silicate derivatives, antomony trioxide, metallic pigment, aluminum flake pigment, and iron oxide. Additionally, the coating may also include one or more of the following functional pigments, such as conductive pigments, flatting pigments for controlling gloss, clays and other rheology modifying pigments.

In one embodiment, as seen in FIG. 3, the coating also includes particles of a low-friction material 214*a* such as PTFE, PFA, MFA, PEEK, PEK and other fluoropolymer or silicone materials. In one embodiment, the particles are micron- and/or sub-micron-sized. In another embodiment, the low-friction material is resistant to chemicals such that the low-friction material will provide a low surface energy outer layer and not corrode, oxidize, break down, form bonds with other materials, or otherwise be affected by contacting other chemicals. In another embodiment, the low-friction material is irradiated, prior to incorporation in the coating, with electron beam particles to create an easily wetted surface which enables better adhesion to the binder material.

In one embodiment, a coating is applied by spraying the surface of a musical string with the coating. In one embodiment, the coating is sprayed on by a siphon, gravity, or pressure pot method which forces the coating through a nozzle at high pressure such that the coating forms a vapor or mist which is directed toward the surface of the musical string. In another embodiment, the coating is applied with a variation of siphon or gravity spraying wherein the coating is sprayed at a lower pressure and in higher volume to reduce the amount of volatile organic compounds released during the spraying process. In another embodiment, a musical string device is dipped into a reservoir filled with the coating. Once submerged, the musical string is removed from the reservoir and "spun" or rapidly rotated to remove excess coating by centrifugal force. In another embodiment, a musical string is "tumbled" in a rotating barrel or other rotating enclosure including a coating. Hot air is blown over the tumbling musical string to at least partially cure the coating as it is applied to the musical string. In another embodiment, a musical string is passed under a falling curtain of the coating to coat the surface of the musical string. In another embodiment, primers including one or more silane coupling agents are applied by dipping the musical strings into a liquid solution followed by applied centrifugal forces to remove any excess primer materials.

In another embodiment, a powder coating system is employed. This powder coating system includes a primer, where required, of a liquid that is preapplied and either cured to dry or remains wet prior to the application of a topcoat of a powder. In this embodiment, the powder may include a low-friction material such as PFA, FEP, PTFE, PE, PEEK, PEK or appropriate low-friction particles or a combination of the above plus appropriate pigments similar to those described in the liquid-type coatings described above.

In another embodiment, an electrostatic, tribo-charged or opposite electrostatic charged liquid spray or powder spray method is used to apply the coating to a musical string. The electrostatically charged spray enables an operator to better control the application uniformity of the coating and thereby enhances the uniformity, density and application of the coating on the surface of the musical string. It should be appreciated that the coating may have one or more characteristics altered to enable for more efficient electrostatic, tribo-charged or opposite electrostatic charged spray techniques to be used to apply the coating to a musical string. It should be further appreciated that the above-described "tribo-charge" or electrically charged application technique alters the edge coverage thickness of the applied coating based on any design requirements which require a more uniformly applied coating to all surfaces of the musical string, whether the configuration has sharp or round edges. This technique results in greater coating transfer efficiency while also optimizing the consistency of the coating coverage thicknesses of the applied coating.

After the coating is applied to the surface of the musical string, the coating is cured to harden the coating and strengthen the bond between the coating and the musical string as indicated in block 104 of FIGS. 1A and 1B. The curing process is performed by heating the coating at a predetermined temperature or temperatures for a predetermined length or lengths of time, air-drying the coating at ambient temperature, or by utilizing any suitable internal or external curing process. It should be appreciated that curing may be accomplished by exposure to light from an infrared, visible, or ultraviolet light source.

Figure 4:
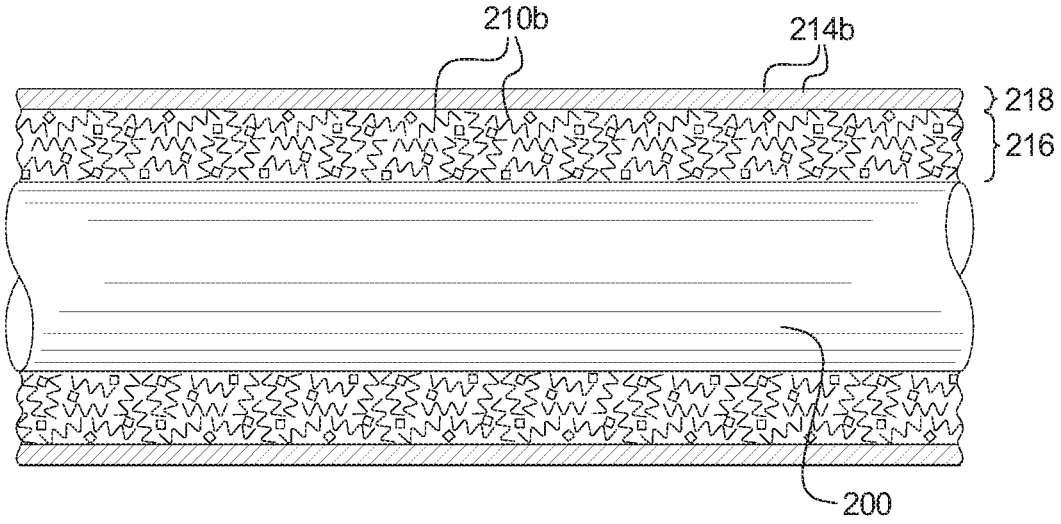
FIG. 4 is a side view, partially in section, of the musical string of FIG. 3 after the coating is cured.
Figure 5:
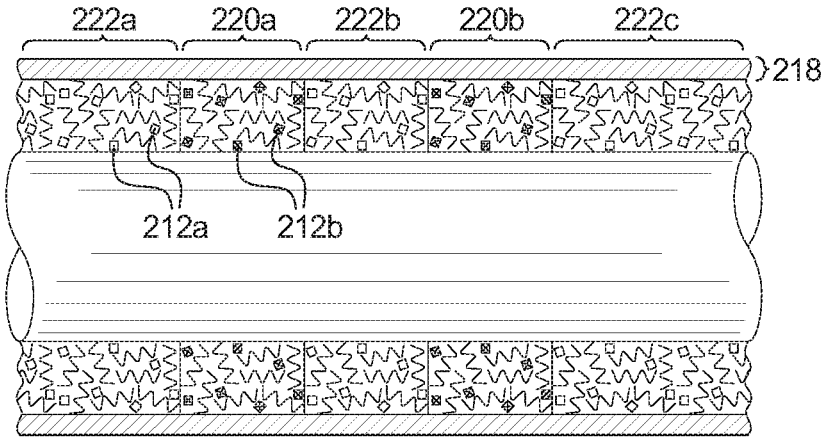
FIG. 5 is a side view, partially in section, of the coated musical string of FIG. 4 including markings resulting from shifting the color of selected areas of the base layer of the coating.

In one embodiment, as illustrated in FIG. 4, during the curing process, the molecules of a binder, such as epoxy 210*a* crosslink and form chemical bonds with each other, and bond with the surface of the musical string. The crosslinked epoxy molecules form an epoxy matrix 216 including crosslinked binder molecules, one or more low-friction materials, one or more pigments, and one or more other ingredients such as wetting agents, coupling agents, hardening agents, and/or other additives. Moreover, during the curing process, the particles of low-friction material such as PTFE 214*b* soften and at least some of the PTFE or other low-friction material is squeezed out or displaced from the epoxy matrix and migrates, rises, or flows to the surface of the coating. At or near the surface of the coating, the PTFE molecules bond or fuse together to form a thin, partially transparent top coat 218 of PTFE on the outer surface of the coating (such that at least some visible light may pass through the low-friction material). When the curing process is complete, as illustrated in FIG. 5, the coating includes a base layer including the epoxy matrix, and a top coat including fused molecules of PTFE. It should be appreciated that when the coating is cured, the epoxy matrix exhibits a first color corresponding to the color of the pigments in the epoxy matrix which is visible through the at least partially transparent PTFE top coat. Accordingly, this embodiment provides a musical string with a transparent, partially transparent or translucent low-friction top coat which is situated above one or more colored pigments to provide a low-friction coated colored musical string.

In one embodiment, different pigments are utilized for different musical strings to associate one or more colors with a musician, a manufacturer of musical strings, a distributor of musical strings and/or an importer of musical strings. In this embodiment, different musicians, different manufacturers, different distributors and/or different importers use different colored musical strings or different groups or combinations of colored musical strings to distinguish themselves from other musicians, manufacturers, distributors and/or importers. In one such embodiment, a musician may be associated with a designated color wherein the pigments along the entire length of one or more of the musical strings for that musician are that designated color (or such pigments are heat activated, as described below, to change the entire length of such musical strings the designated color). For example, certain musicians want their entire costumes and all their musical instruments to be monochromatic and such a monochromatic musical string provides that even the musical strings of their musical instruments are the same color.

In another embodiment, the coating disclosed herein includes pigments which are different colors in normal daylight and artificial lighting, such as colors that fluoresce under ultraviolet or "black" light. Such coated musical strings provide a musician/entertainer with another method of identifying a specific musical string visually and also providing a visual affect for the audience to differentiate that musician from any other musicians on the same stage.

In one such embodiment, a musical string includes a primer or base coating that contains pigments that fluoresce under "black" light or certain artificial lamps. In another such embodiment, a musical string includes a primer or base coating that contains pigments that glow in the dark when subjected to "black" light or electromagnetic radiation in the near ultraviolet range of light. In different embodiments, the fluorescent pigments are incorporated into a base coating including an epoxy, a polyimide-amide, PES (or other suitable high strength resins) and particles of PTFE (or other suitable low friction material). In one embodiment, such a fluorescing primer or base coat is then covered with a separate, liquid or powder low friction coating. The two coatings are then cured using appropriate heat (or another suitable energy source) such that the topcoat is integrally bonded to the base coat providing the tactile benefits described above. In this embodiment, the bonded coatings form a two coat, low friction colored coating containing selected pigments or mixtures of pigments and additives that results in a first range of visible color under a first lighting condition (such as in daylight). In this embodiment, when subjected to "black" light, ultraviolet light or other artificial light, the coated musical strings will change from a translucent or colored primary color to a vivid fluorescent color, such as but not limited to: white, green blue, pink yellow, red, black, grey or any suitable color combination. Accordingly, this embodiment provides a musical string wherein the strings appear as a second range of visible color under a second lighting condition (such as when exposed to an ultraviolet light or other artificial light) to create a vivid color on the coated musical strings of the instrument. It should be appreciated that this process may be combined with one or more of the different marking processes or coating elements described herein.

In one embodiment, a string is coated in discrete lengths, wherein certain portions of the string are coated with one or more of the coatings described herein and certain other portions of the string are not coated with one or more of the coatings described herein. In another embodiment, a string is coated in a continuous length (i.e., a reel-to-reel coating), wherein the entire surface of the string is coated with one or more of the coatings described herein. In one such embodiment, after a string has been coated (either over discrete lengths or a continuous length) is the coated string assembled to form a wound string as disclosed herein.

In one embodiment, different amounts of coatings are applied to different segments of the musical string disclosed herein. In one such embodiment, the segment or area of the musical string near the frets of the musical instrument are coated with a lighter or thinner low-friction coating while the segment or area of the musical string that is fingered or picked is coated with a heavier or thicker wear-resistance coating.

Figure 3A:
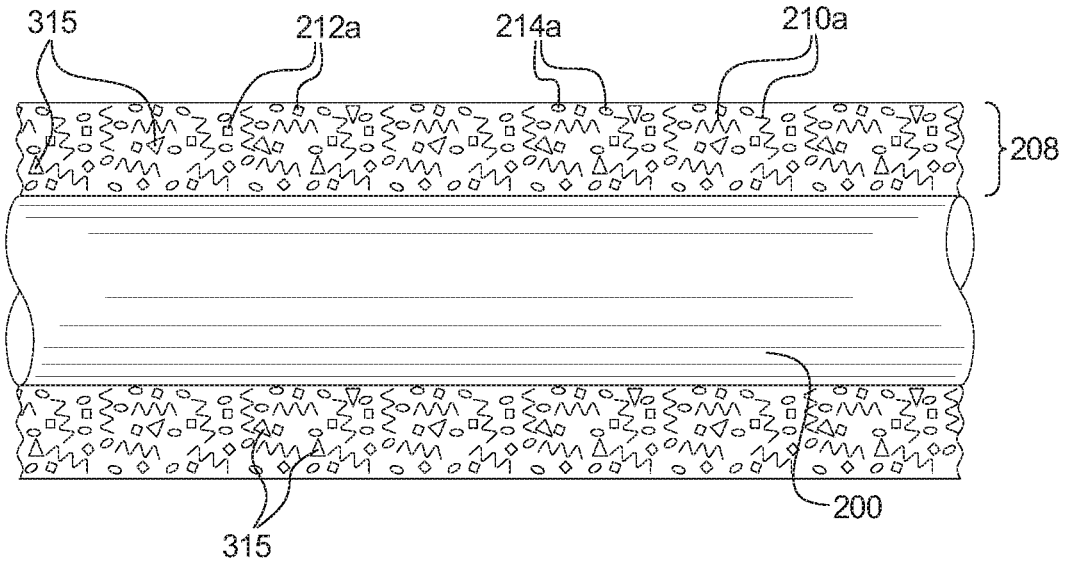
FIG. 3A is a side view, partially in section, of another embodiment of the musical string of FIG. 2 including an uncured coating applied to the surface thereof, the uncured coating at least including a plurality of anti-microbial particles.
Figure 4A:
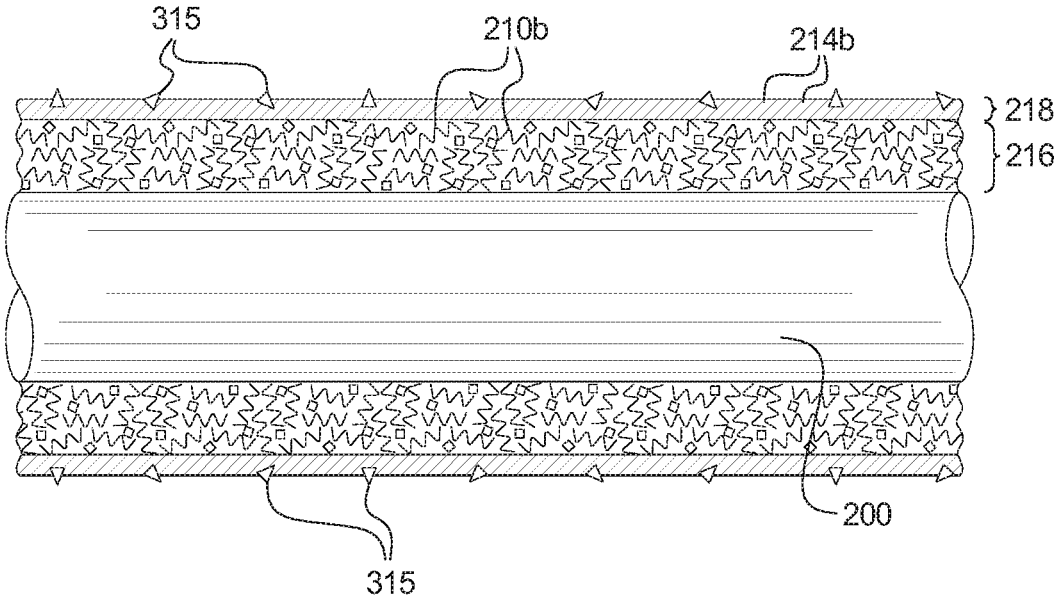
FIG. 4A is a side view, partially in section, of the embodiment of the musical string of FIG. 3A after the coating is cured.
Figure 5A:
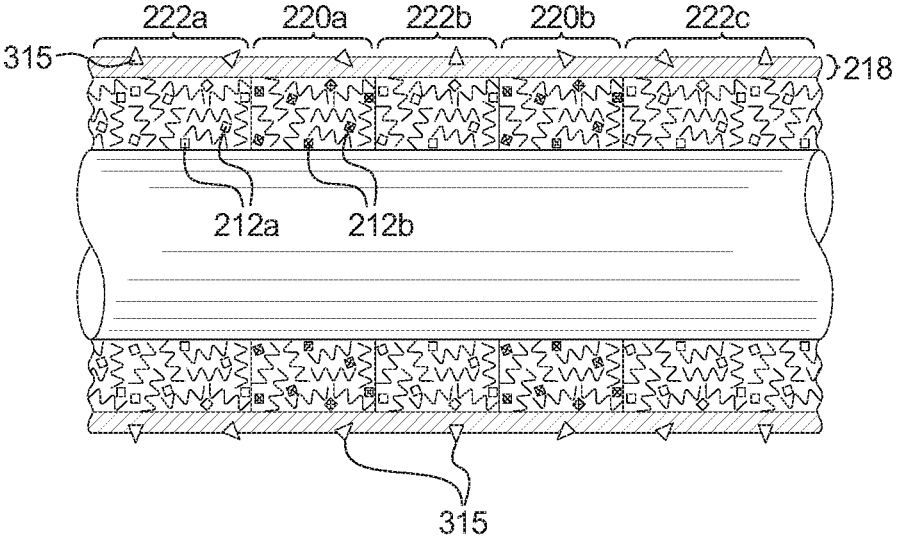
FIG. 5A is a side view, partially in section, of the embodiment of the coated musical string of FIG. 4A including markings resulting from shifting the color of selected areas of the base layer of the coating.

In one embodiment, a plurality of anti-microbial particles such as silver, ceramic, silver ceramic, silver oxide, glass silver or silver compounds or any suitable anti-microbial agent are applied to one or more of the surfaces of the coated string to reduce and kill bacteria and other potential germs that are located on the surface(s) of the coated string or otherwise incorporated into the coating formulation. In one embodiment, the anti-microbial particles are interspersed with the uncured coating. During the curing process, some of the anti-microbial particles migrate or rise to the surface of the coating in addition to the low-friction material. The anti-microbial particles are capable of killing bacteria and other harmful organisms which contact the surface of the coated musical string while in storage or while the coated musical string is in use. For example, as seen in FIG. 3A, one embodiment of the musical string is illustrated wherein the musical string 200 includes an uncured coating 208 applied to its surface, the coating including a binder material 210*a*, at least one pigment 212*a*, a plurality of particles of a low-friction material 214*a* and a plurality of particles of an anti-microbial material 315. As seen in FIG. 4A, during the curing process: (i) the molecules of a binder, such as epoxy 210 crosslink, form chemical bonds with each other, and bond with the surface of the musical string to form an epoxy matrix 216; (ii) the particles of low-friction material such as PTFE 214 soften, at least some of the PTFE or other low-friction material is squeezed out or displaced from the epoxy matrix and migrates, rises, or flows to the surface of the coating where such PTFE molecules bond or fuse together to form a thin, partially transparent top coat 218 of PTFE on the outer surface of the coating; and (iii) some of the anti-microbial particles 315 migrate or rise to the surface of the coating. In this illustrated example, when the curing process is complete, as seen in FIG. 5A, the coating includes a base layer including the epoxy matrix, and a top coat including fused molecules of PTFE, wherein some of the anti-microbial particles 315 partially protrude from the top coat.

In another embodiment, a clear or transparent top coat is applied to one or more of the surfaces of the coated musical string. In different embodiments, the top coating is a liquid or powder low-friction or release coating or material, such as fluorinated materials, polytetrafluoroethylene, perfluoroalkoxy, fluoroethylenepropylene, MFA, PEEK, PEK, polyethylene, silicone, ceramic composites, paralyene silane polymers, a modified fluoropolymer, an irradiated polymer powder, an irradiated polymer particle, a graphite, carbon nanotubes, carbon particles, silicone materials and other suitable low-friction coatings. In different embodiments, the top coating is a liquid or powder high-strength clear or translucent PTFE or low-friction based material. In one embodiment, such a top coating provides that any colored pigments and/or any created markings (as described below) are substantially covered or sealed underneath an additional layer skin of a low friction coating. Such a top coating can be selectively applied to the length of the musical string, whereby no additional topcoat is applied to the portion of the musical string that is tensioned or adjusted.

In one embodiment, the pigment included in the coating is a heat activated pigment or laser excitable pigment configured to change color when heated above a color shifting temperature. In this embodiment, the color shifting temperature is greater than the designated temperature at which the coating is cured (such as by 50-100° F. (10-38° C.)) to enable the coating to be cured without changing the color of the pigment during the curing process. In this embodiment, the color shifting temperature of the heat activated pigment is also lower than the temperatures at which either the low-friction characteristics of the low-friction material, or the adhesive characteristics of the binder resin, are substantially affected, degraded, or deteriorated, or the chemical composition, characteristics, functions, or properties of the low-friction coating and/or base resin are changed.

Figure 6:
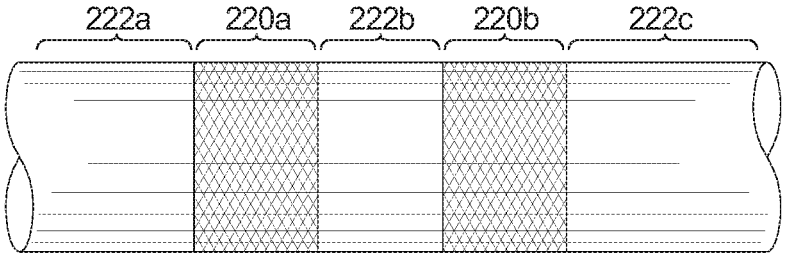
FIG. 6 is a side view of the coated musical string of FIG. 5.

In one such embodiment, after curing the applied coating to harden the coating and form a low-friction top coat, one or more portions of the coating are selectively heated to change the pigment from a first color to a second different color as indicated in block 106 of FIG. 1B. As seen in FIGS. 5 & 6, markings 220*a* and 220*b* are created on the coated musical string by selectively heating portions of the coating above a color shifting temperature while simultaneously maintaining adjacent portions 222*a*, 220*b*, and 220*c* at a cooler temperature (with a suitable masking device). When heated above the color shifting temperature, the pigment in the selectively heated portions changes from a first color to a second color. For example, in one embodiment, as illustrated in FIG. 5, the coating applied to the musical string is generally light blue in color. However, at measured intervals along the length of the musical string, short sections of the base layer of the coating are dark brown or black in color. Thus, a first segment such as a 100 mm long segment of the coated musical string is light blue in color. A second adjacent segment such as a 3 cm long segment of the coated musical string is dark brown in color, and a third segment such as a 50 mm long segment, adjacent to the second segment, is light blue in color. The pattern of alternating light blue and dark brown or black segments is repeated from the adjustable end to the attached end of the coated musical string, resulting in a coated musical string having markings which visually indicate each 50 mm of length of the coated musical string. It should be appreciated that the color transitions of the coated musical string may be absolute (i.e., a first color ends and a second, contrasting color begins) or gradual or feathered (i.e., a first color bleeds into a second, transitioning color which bleeds into a third color which contrasts with the first color). It should be appreciated that these markings are examples of a color shifting process, wherein such markings may be used, at any end of the musical string, to denote style, size, quality, brand name, finger location for specific musical notes, lot or manufacturing codes and similar identification markings.

Figure 7:
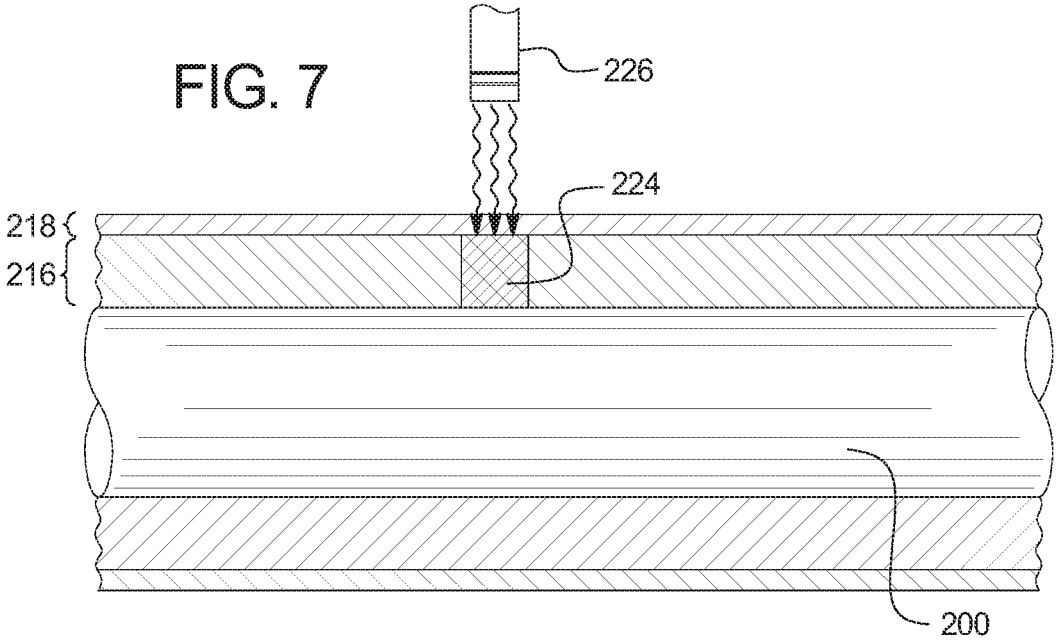
FIG. 7 is a side view, partially in section, of the coated musical string of FIGS. 5 to 6, including a laser for heating portions of the coating of the coated musical string.

Referring to FIG. 7, in one or more embodiments, the pigment in the coating is heated above the color shifting temperature by radiated heat. Radiated heat is applied from any radiant source, such as hot air, open flame, heated filaments, or lasers 226. Radiated heat can be directed to specific portions of the coating by masking portions of the coating (with a suitable masking device) that are not intended to be heated above the color shifting temperature. Masking is accomplished by any suitable mechanism configured to shield the coating from the heat source. In one embodiment, hot air is blown toward a specific portion of the coating through a nozzle or other apparatus of directing or funneling air. In another embodiment, when radiated or infrared heat is directed to a portion 224 of the coating, the at least partially transparent top coat enables certain designated amounts of radiated or infrared heat to pass through the top coat to the base layer, which absorbs the heat. This method heats the base layer while simultaneously keeping the low-friction top coat at a slightly cooler temperature, which has the advantage of preserving the low-friction character of the top coat and maintains the at least partial transparency of the top coat.

In different embodiments, radiation, microwaves, concentrated sound waves or other vibrations, or other external energy sources may also be used to selectively stimulate the pigment and/or binder resin to cause the pigment and/or binder resin to shift color. In another embodiment, laser energy, such as provided by a $CO_2$ (carbon dioxide), YAG lasers (Ytterbium), and fiber laser systems, provide the necessary energy to selectively stimulate the pigment and/or binder resin to cause the pigment, additive and/or binder resin to shift color. In this embodiment, these lasers have different depths of penetration, different "dot" sizes and/or different energy outputs which can be pulsed to selectively stimulate the pigment and/or binder resin to cause the pigment and/or binder resin to shift color. In different embodiments, the coated musical strings includes a plurality of relatively small sized dots of color shifted pigments (created by the appropriate laser energy) to form legible letters, numbers or symbols which can be used to denote manufacturer, date of production, quality of string, lot of production, serial number, finger location for specific musical notes, and any number of suitable identifications relating to the musical string.

Figure 8:
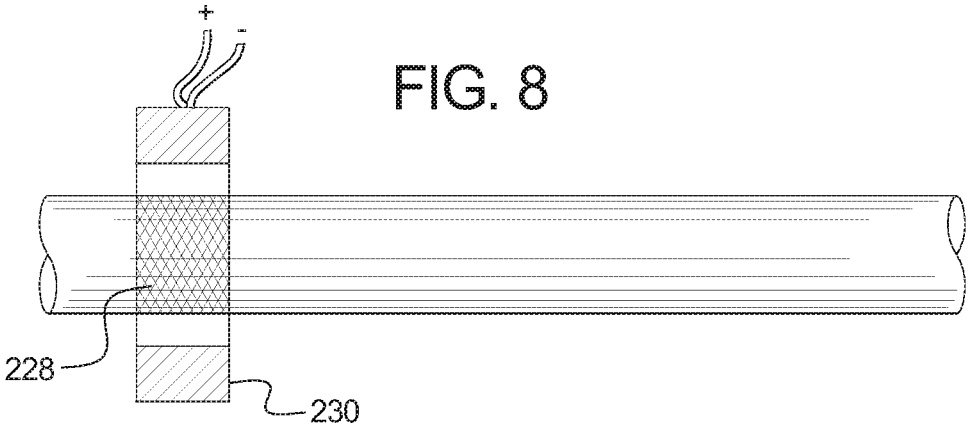
FIG. 8 is a side view of the coated musical string of FIGS. 5 to 6 including a magnetic induction coil for heating portions of the coated musical string.

In another embodiment, the musical string is formed from a magnetic-type steel and is heated by magnetic induction (as seen in FIG. 8) wherein an induction coil 230 is energized with a frequency current, which imparts thermal energy in the musical string. In this embodiment, electrical resistance in the musical string causes electrical current energy to transform into heat energy. Heat from the musical string then transfers to the base layer by thermal conduction, thus shifting the color of the portion of the base layer 228 above the heated segment of the musical string. This method also has the advantage of keeping the low-friction top coat at a slightly cooler temperature, which preserves the low-friction character of the top coat. It should be appreciated that any suitable external energy source, such as flame heat, short wave infrared, medium wave infrared, hot air (electrically heated) with little orifices to make a small mark on the musical string, induction heat provided through a "bobby pin" or circular shaped coil and/or at right angles, and/or heat provided using induction energy may be used to stimulate the pigment and/or binder resin to cause the pigment and/or binder resin to be heated to shift color.

In one embodiment, markings are created in the coating in any desired pattern or colors, or any combination of patterns and colors. In one such embodiment, creating areas of shifted color on one or more coated strings can result in specific markings, such as a company logo or musical band name, displayed on the coated musical strings disclosed herein. In another embodiment, creating areas of shifted color on one or more coated strings can result in specific markings displayed on the coated musical strings, such as indications of where a musician should place their fingers at designated locations to play a specific musical note. In one such embodiment, each of the musical strings of a stringed instrument is coated with a different color (which can include different shades of a color) which are created by heating the musical strings at different heat ranges. In this embodiment, a beginning student can quickly identify the exact string by the specific color of that string. In another embodiment, creating areas of shifted color on one or more coated strings can result in decorative color markings which different musicians may use to distinguish themselves from other musicians.

Figure 9:
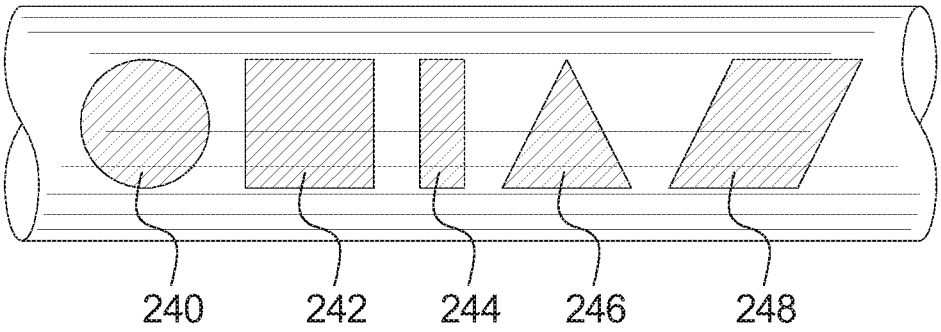
FIG. 9 is a side view of the coated musical string of FIGS. 5 to 6 including markings having geometric shapes.

In different embodiments, the formed markings disclosed herein indicate any suitable information including, but not limited to: a length of the musical string, one or more designated locations along the musical string, a size, a type, one or more materials, a part number, a lot number, a lot code, a style markings, a batch number, a manufacturing date, a location of manufacturing, a manufacturing code, a serial number, and/or a manufacturer of the coated musical string or any suitable identification information and/or counterfeit protection information. The formed markings can also include one or more bar codes or other codes, or other properties or instructions associated with the coated musical string. In another embodiment, the markings are utilized to provide one or more musical strings of a commemorative string set which includes one or more markings of a particular design for a musician or group of musicians. In another embodiment, as illustrated in FIG. 9, one or more geometric shapes, including but not limited to circles 240, squares 242, rectangles 244, triangles 246, parallelograms 248, and other polygrams are created in the coating of the musical string.

Figure 10:
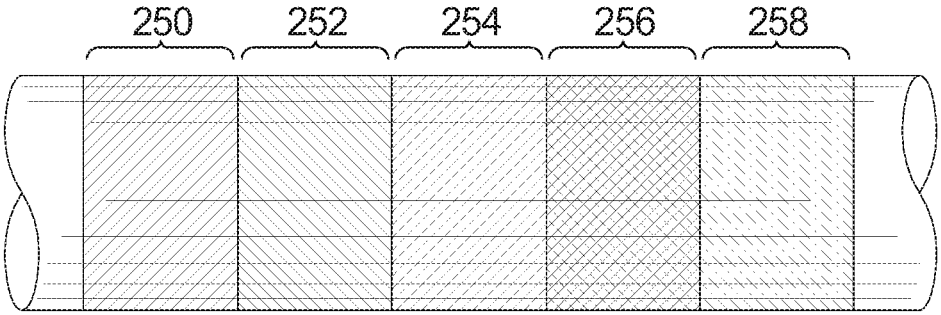
FIG. 10 is a side view of the coated musical string of FIGS. 5 to 6 including markings having different colors.

In another embodiment, a plurality of different colors are created to indicate distances from the middle point, adjustable end or attached end of the coated musical string. The different colors are created by selectively heating a plurality of different pigments (with different properties and color shifting temperatures) above their respective color shifting temperatures. For example, in one embodiment, a progression of a plurality of uninterrupted colors is created along the length of the coated musical string. For illustrative purposes only, FIG. 10 illustrates one embodiment wherein a first segment 250 of the coating of the musical string is a first color. A second segment 252 of the musical string adjacent to the first segment is a second color. The adjacent segments 254, 256, and 258, are also each different colors. In different embodiments, such adjacent segments are suitably spaced, such as 1, 2 3, 4 and/or 6 mm marks to provide different segments of different colors. It should be further appreciated that a combination of one or more marking methods disclosed herein can provide musician with additional information about the musical string of the stringed musical instrument. For example, the embodiment of FIG. 10 includes segments of different colors and also includes equally spaced markings of a first color.

Figure 11:
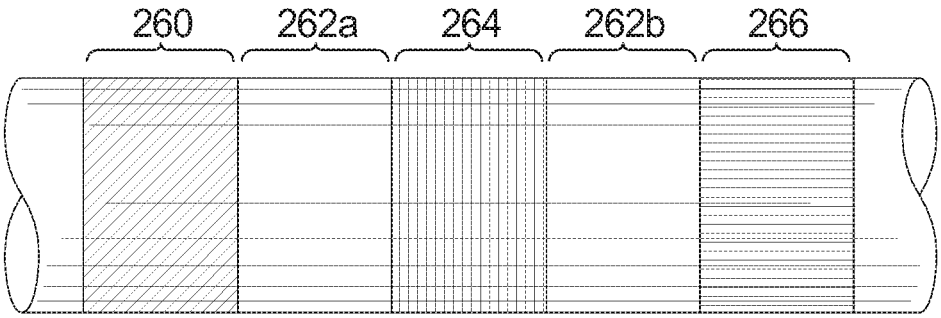
FIG. 11 is a side view of the coated musical string of FIGS. 5 to 6 including a progression of a plurality of interrupted colors along the length of the musical string.

In another embodiment, a progression of a plurality of interrupted colors is created along the length of the coated musical string. For illustrative purposes only, FIG. 11 illustrates one embodiment wherein a first segment 260 of the coating of the musical string is a first color, a second segment 262*a* of the musical string adjacent to the first segment has not been selectively heated and is a default, second color of the cured base material. For this example, a third segment 264 of the coating of the musical string is a third color, a fourth segment 262*b* of the musical string adjacent to the third segment has not been selectively heated and is the default, second color of the cured base material and a fifth segment 266 of the coating of the musical string is a fourth color.

Figure 12:
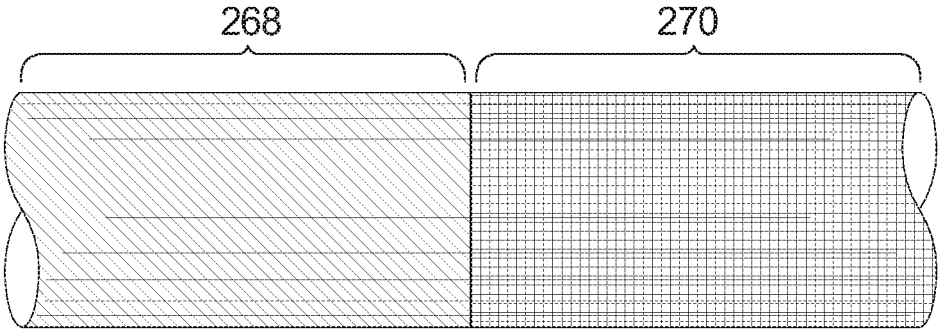
FIG. 12 is a side view of the coated musical string of FIGS. 5 to 6 including a first shifted color which runs from an adjustable end of the musical string to a halfway or middle point of the musical string and a second, different, contrasting color which runs from the attached end of the musical string to the halfway or middle point of the musical string.

In another embodiment, a coated musical string disclosed herein includes a first shifted color (which runs from an attached end of the coated musical string to a halfway or middle point of the coated musical string) and a second, different, contrasting color (which runs from the adjustable end of the coated musical string to the halfway or middle point of the coated musical string). For illustrative purposes only, FIG. 12 illustrates one embodiment wherein a first segment 268 of the musical string (which runs from the attached end of the musical string to a middle point) is coated and selectively heated to a first color shifting temperature to change the color of a first pigment (and thus change the color of the first segment) to a first color, such a green. As further seen in FIG. 12, a second segment 270 of the musical string (which is of equal or substantially equal length as the first segment and runs from the adjustable end of the musical string to the middle point) is coated and selectively heated to a second color shifting temperature to change the color of a second, different pigment (and thus change the color of the second segment) to a second, different color, such as yellow.

Figure 13:
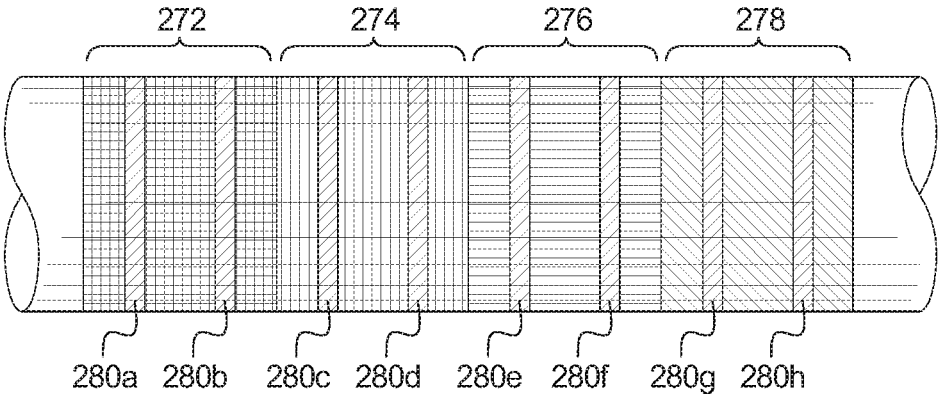
FIG. 13 is a side view of the coated musical string of FIGS. 5 to 6 including a plurality of pigments having different color shifting characteristics, wherein certain portions of the coating include a plurality of pigments that shift color.

In another embodiment, a plurality of pigments having different color shifting characteristics are included in the coating, wherein certain portions of the coating include a plurality of pigments that shift color. For illustrative purposes only, FIG. 13 illustrates one embodiment wherein a first segment 272 of the musical string (which accounts for 25% of the length of the musical string) is coated and selectively heated to a first color shifting temperature to change the color of a first pigment (and thus change the color of the first segment) to a first color, such as yellow. As further seen in FIG. 13, a second segment 274 of the musical string (which accounts for another 25% of the length of the musical string) is coated and selectively heated to a second color shifting temperature to change the color of a second pigment (and thus change the color of the second segment) to a second color, a third segment 276 of the musical string (which accounts for another 25% of the length of the musical string) is coated and selectively heated to a third color shifting temperature to change the color of a third pigment (and thus change the color of the third segment) to a third color and a fourth segment 278 of the musical string (which accounts for another 25% of the length of the musical string) is coated and selectively heated to a fourth color shifting temperature to change the color of a fourth pigment (and thus change the color of the fourth segment) to a fourth color. In this example, in addition to using heat activated pigments to shift the colors of the four segments, additional markings 280*a* to 280*h* are created along the length of the musical string by utilizing laser activated pigments to selectively change certain portions of the musical string a fifth color. That is, although one or more pigments located in the coating of the first segment of the musical string were previously heat activated to change the first segment to a yellow color, additional pigments located in the coating of the first segment are laser activated to indicated marks 280*a* and 280*b* as a brown color in the first segment.

In another such embodiment which utilizes a plurality of pigments having different color shifting characteristics in the coating (not shown), a first segment of a coated musical string (which runs from the attached end of the musical string to a designated point of the coated musical string) is selectively heated to a first color shifting temperature to change the color of a first pigment (and thus change the color of the first segment) to a first color, such a black. In this embodiment, a second segment of the coated musical string (which runs from the adjustable end of the musical string to the designated point) is then selectively heated to a second color shifting temperature to change the color of a second, different pigment (and thus change the color of the second segment) to a second, different color, such as yellow. In this embodiment, a third pigment located in certain portions of the first segment of the coated musical string are excited or otherwise activated to change to a third color, such as white (and thus create suitable markings in the first segment of the coated musical string) and a fourth pigment located in certain portions of the second segment of the coated musical string are excited or otherwise activated to change to a fourth color, such as brown (and thus create suitable markings in the second segment of the coated musical string).

In another embodiment, different heat activated pigments are utilized to denote different information, such as diameters, lengths, sizes and/or tonal qualities of different coated musical strings. For example, a first coated musical string of a first length is heated at or above a first color shifting temperature to cause a first pigment (in the base layer applied to the first coated musical string) to change to a first designated color. In this example, a second coated musical string of a second, different length is heated at or above a second color shifting temperature to cause a second pigment (in the base layer applied to the second coated musical string) to change to a second designated color. Accordingly, by utilizing different heat activated pigments, different coated musical strings of different lengths can be properly identified without increasing or decreasing the diameter of the coated musical string, or significantly adversely affecting the function of the low-friction coating applied to such coated musical strings.

In another embodiment, at designated points on the coated musical string, the color shifting material is applied and the marks are created in a gradation of successively, incrementally darker colors by using gradually increasing or higher energy levels in directly adjacent areas to create a progressively darker and darker mark to further enhance the ability of the device manufacturer to create markings on the coated musical string. This gradation of color shift method can be combined with cessation of energy input to create "breaks" in the color gradation to denote marks which are of the original color and are notably different from the gradation of darker markings.

In another embodiment, a plurality of pigments having different color shifting temperatures are included in the coating. By selectively heating portions of the coating above the color shifting temperature of a first pigment but below the color shifting temperature of a second pigment, the color of the coating can be changed from a first color to a second different color. By selectively heating portions of the coating above the color shifting temperature of the second pigment, the color of the coating can be changed from the first color to a third different color. In one embodiment, for example, a coated musical string includes a base color such as light blue, a first set of markings in a second color, such as tan, and a second set of markings in a third color such as brown or a lighter color such as white or tan.

In one such embodiment, one or more of the pigments in the coating are formulated to change or shift colors a plurality of times. For example, a designated pigment in the coating is initially a green or blue color that will change or shift to a white or white/grey color with one level of laser energy. In this example, the designated pigment will further change or shift to a dark black color with another, higher laser energy. Accordingly, such pigments are formulated, depending on the different levels of applied laser energy, different laser types or different color shifting temperatures, to provide a plurality of different color markings on a single coated musical string.

In another embodiment, the coating applied to the musical string includes a first non-heat activated pigment and one or more heat activated second pigments. In this embodiment, the musical string has a base color (i.e., the first pigment), wherein different areas of the musical string may shift colors to indicate one or more additional colors (i.e., the activated second pigments). It should be appreciated that any suitable decorative use of the coated musical strings disclosed herein is contemplated.

In another embodiment, the low-friction applied liquid coating disclosed herein prevents or delays the corrosion of musical strings. In another embodiment, a liquid primer coating or layer is applied to the surface of the musical string and then, while the liquid layer is still wet, a low-friction powder top coating or layer is applied over the liquid primer layer. In one such embodiment, ultrasonic energy is used to enhance and assist the penetration of thin (e.g., at least one-angstrom thick) deposits of the liquid or powder corrosion resistant coating to the inner surfaces, the outer surfaces and the interstices of the wound musical string. Such coating provides corrosion resistance that does not affect the tonal quality of the musical string (and maintains the tonal quality of the musical string longer than an uncoated musical string).

In one such embodiment, a corrosion resistant liquid coating primer or base is first applied to the inner surfaces, the outer surfaces and the interstices of the wound musical string and then a second coating or layer including any suitable energy activated pigment is applied to this coated musical string. In this embodiment, any subsequently applied pigmented topcoat placed over the corrosion resistant coating (previously applied to the outer layer of the wound musical string) will provide a musical string with low friction and corrosion resistance characteristics, as well as color identification and the ability to be selectively marked. In another embodiment, a corrosion resistant coating or base is first applied to the inner surfaces, the outer surfaces and the interstices of the wound musical string and then a second clear or translucent topcoat is applied to this coated musical string. In this embodiment, the subsequently applied clear topcoat placed over the corrosion resistant coating previously applied to the outer layer of the wound musical string will provide a musical string with low friction and corrosion resistance characteristics.

Figure 1C:
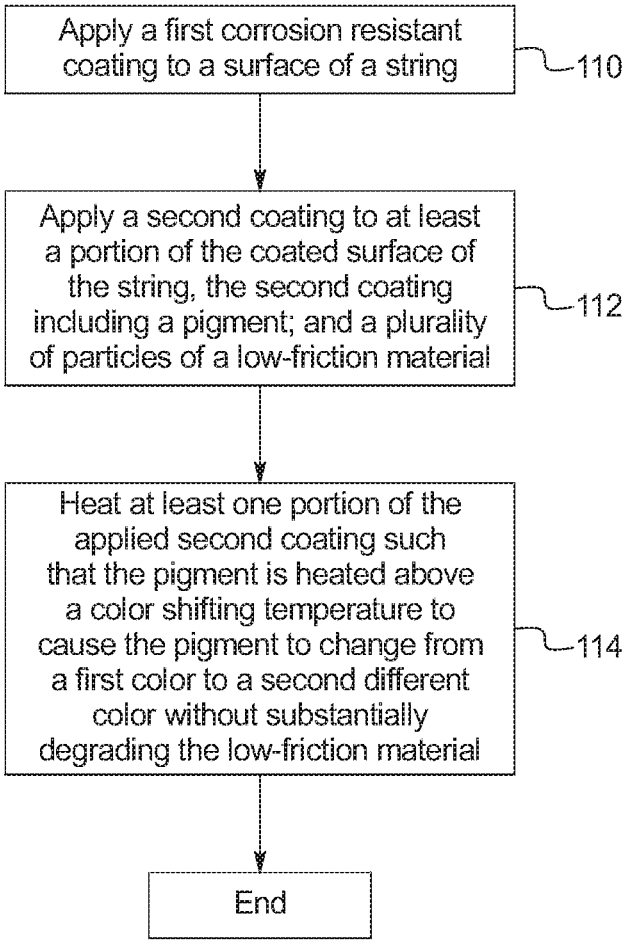
FIG. 1C is a flow chart describing one embodiment of the disclosed method of coating and marking a string.

As seen in FIG. 1C, in one example embodiment, after preparing a string for coating, a first corrosion resistant coating is applied to a surface of a string as indicated in block 110. Following the application of this first corrosion resistant coating, as indicated in block 112, a second coating a applied to at least a portion of the coated surface of the string. As further indicated in block 112, this second coating includes a pigment and a plurality of particles of a low-friction material. Following the application of the second coating, as indicated in block 114, at least one portion of the applied second coating is heated. As further seen in block 114, the pigment is heated above a color shifting temperature to cause the pigment to change from a first color to a second different color without substantially degrading the low-friction material.

In another embodiment, a first or base low-friction layer, including a low-friction material, such as PTFE, is applied to a surface of the musical sting and suitably cured. In one such embodiment, the first low-friction layer includes a first relatively light colored pigment, such as a white colored pigment. After applying the first low-friction layer, a relatively thin (as compared to the first or base low-friction layer) second low-friction layer, including a low-friction material, such as PTFE, is applied to the coated surface of the musical string and suitably cured to bond the two layers together. In one such embodiment, the second low-friction layer includes a second relatively dark colored pigment, such as a green, black or blue colored pigment. In another such embodiment, the second low-friction layer also includes one or more laser receptive pigments.

After applying the two low-friction layers of contrasting color, a suitable laser and laser energy is selectively applied to different areas of the coated musical string. In this embodiment, the laser ablates or removes the relatively thin outer second low-friction layer while not adversely affecting the first low-friction layer. That is, the second low-friction layer with the relatively dark colored pigment (and optionally the additional laser receptive pigments) absorbs the energy (or more of the energy) of the laser and is accordingly vaporized or ablated from the coated surface of the musical string, while the first low-friction layer with a relatively light colored pigment does not absorb the energy of the laser and is thus not affected by (or is not significantly affected by) the applied laser energy. After the laser energy is selectively applied to different areas of the musical string, the resulting outer surfaces of the laser applied areas of the musical string will include the first low-friction, light colored coating and the outer surfaces of the non-laser applied areas of the musical string will include the second low-friction dark colored coating. It should be appreciated that since a thin layer of the dark colored low-friction material is applied to the musical string, when that thin layer is removed from the musical string, any diametrical reductions of the diameter of the surface of the low-friction coating will be relatively shallow and not create any substantially sharp edged shoulders which can scrape a musician's fingers or hands as they play a musical instrument which utilizes such coated strings. It should be appreciated that the laser energy which creates the ablation of the second or outer low-friction layer can be reduced along and nearest the edges or margins of the ablated area to create a tapering effect (i.e., a smoothening of the diametrical transition) thus reducing the tactile feeling of a "notch" between the two layers of different colored coatings.

In another embodiment, a base coating or primer is a first color and the low-friction top coating or outer layer is a second contrasting color. In this embodiment, as the low-friction top coating wears away due to use, it exposes the different colored lower layer. Such an embodiment informs or otherwise "warns" the musician to consider changing musical strings.

In another embodiment, a coating which is formulated with magnetic receptive pigments and/or electromagnetic receptive pigments is utilized, wherein these magnetic receptive pigments will provide internal heat when subjected to one or more appropriate magnetic fields or electromagnetic fields. In this embodiment, such magnetic receptive pigments are applied to non-magnetic substrates, such as non-magnetic stainless steel, ceramics, plastic or polymers. Such magnetic receptive pigments are formulated with low-friction materials and appropriate color pigments and binders, such as epoxy and polyimide, which when cured at a suitable temperature provides adhesion to the substrate and also creates the low-friction surface. In this embodiment, the musical string is subsequently internally heated by exciting or energizing the dispersed magnetic receptive particles, which causes select areas of the musical string to change colors from the primary color to a darker color in the areas where the coated device is selectively subjected to the magnetic forces, while not overheating either the binder resin or the outer layer of low-friction material.

In another embodiment, as mentioned above, the coating includes additives, such as silane coupling agents, other materials formulated to improve the bonding capabilities of a coating to the surface of the musical string, particularly smooth surfaces, or other materials which modify the curing characteristics or the drying characteristics of the coating before curing. In another embodiment, the coating includes additives to improve the wear characteristics, corrosion resistance, and/or electrical properties of the coating. For example, in one embodiment, the uncured coating includes approximately 30%-50% by volume of a base resin, 1%-30% of a heat stable pigment, and 0.5%-15% of a pigment that shifts from a first color to a second, contrasting color when heated from a first temperature to a second temperature which is 20-200° F. (11-93° C.) higher than the first temperature. The uncured coating also includes 2%-10% by volume of low-friction particles and trace amounts of a wetting agent, a silane coupling agent, a hardening agent, and/or curing or drying agents.

In another embodiment, a steel musical string is treated with a thin layer of phosphate or a phosphate type cleaner which reacts or binds with the steel surface to promote the adhesion of a coating, improve the corrosion resistance, and improve the chemical protection of the musical string. In another embodiment, conversion coating or anodizing of an aluminum musical string is employed to promote adhesion of a coating to the musical string and increase the surface hardness and corrosion resistance of the musical string.

In another embodiment, an additional clear or transparent top coat layer (as described above) is applied in a separate operation either after the color shift marks are created or after the marks are created in the base coat. In another embodiment, an ultraviolet cure ("uv cure") low-friction, thin layer of a specially formulated, clear, unpigmented, uv cure resin/fluoropolymer or resin/polyethylene material is formed over the marked musical string after the base coating is applied, cured and post marked. This lowers the friction of the surface since no heat is used to cure the uv material and no change in the marked lower base coating takes place which may be employed for lower temperature base materials like plastics or high friction reinforced plastics. In another embodiment, this additional top coating includes one or more color shifting pigments (i.e., pigments configured to shift color when a suitable amount of energy is applied to such pigments) as described herein.

In another embodiment, a clear or translucent base material is adhered to a musical string that contains laser sensitive or excitable laser receptive pigments. This layer is subsequently topcoated with another clear layer of low friction liquid or low friction powder material which includes PTFE and one or more strengthening agents. In this embodiment, when the laser energy is directed at the coated musical string, the laser pigment turns colors like black or brown, but since no such pigment is in the separate bonded topcoat, the markings in the base coat are seen by the viewer. Accordingly, such markings can form bands, dots, dashes, letters, numbers or any manner of identifying marks.

In one embodiment, the musical string disclosed herein is sequentially coated, cured and selectively heated. For example, a musical string is entirely coated, entirely cured and then selectively heated at designated locations to cause the pigment and/or binder resin to shift color. In another embodiment, different portions of the musical string are coated, cured and selectively heated simultaneously. In these embodiments, the musical string is coated in a suitable coater or utilizing a suitable coating device, the musical string is cured in a suitable curer or utilizing a suitable curing device and the coated musical string is selectively heated with a selective heater or utilizing a suitable selective heating device.

In another embodiment, the musical string is cleaned (as described above), but the fixed end of the string is covered or masked to prevent any coating from adhering to this portion of the string. In this embodiment, the subsequently applied low friction coating is localized to the area that is exposed to the coating and/or marking process. In another embodiment, the base coating is applied to the musical string (as described above), but the fixed end of the string is subsequently covered or masked to prevent the second or subsequent low friction/corrosion resistant coatings from adhering to the portions of the fixed end of the string that are masked or covered. It should be appreciated that these embodiments provide that the portion or area of the musical string that is in contact with a pick or a bow (at or near the fixed end) is not coated (or thinly coated) and the portion or area of the musical string that is in contact with a musician's fingers and/or the fret board (at or near the adjustable end) includes a suitable amount of low friction/corrosion resistant coatings (and zero, one or more markings as described above) to stop the finger squeaking and reduce fret wear.

It should be appreciated that while the coated string disclosed herein is described as and illustrated as a coated musical string, any suitable string may be coated and utilized as described above. That is, one or more of the above-described coatings may be applied to any suitable type of string in any suitable manner described herein. In one embodiment, the coated string is implemented as a sports string utilized in one or more articles of sporting equipment, such as a tennis racquet string. In one such embodiment, when applied to a sports string (for use in one or more articles of sporting equipment), the coating disclosed herein provides a reduction in inter-string friction which provides a more efficient transfer of energy when the sports string rebounds from being stretched. For example, a tennis racquet string coated with the coating disclosed herein would provide a reduced amount of inter-string friction and thus provide a more efficient transfer of energy from the stretched coated sports string to a tennis ball when the coated tennis racquet string rebounds after striking the tennis ball.

In different embodiments, the coated sports string disclosed herein may be utilized in any suitable stringed sporting equipment in use in the athletic industry, whether by an amateur or professional athlete including, but not limited to: tennis racquets, racquetball racquets, lacrosse sticks, badminton racquets and squash racquets. In different embodiments, such strings can be constructed from any suitable material, including but not limited to natural materials, synthetic materials, combinations of natural and synthetic materials. In different embodiments, such strings are constructed from polyamides, nylon/polyamides, non-metallic composite materials, or metals such as steel (both high-carbon and low-carbon content), stainless steel, aluminum, titanium, copper, nickel, silver, nitinol, and other metals and metal alloys and any combination thereof. In different embodiments, the strings are constructed from parent material or combinations of glass, ceramics, rubber, any suitable polymer material and any suitable plastic, including but not limited to nylon, Perlon®, Kevlar®, PEEK, PEK, PPS, ABS, polycarbonate, epoxy, polyester, and phenolic, or any combination thereof.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A method of manufacturing a coated metal string, said method comprising:

(a) applying a corrosion resistant liquid base coating to a first area of a round surface of a metal string;

(b) while the applied corrosion resistant liquid base coating is wet, applying a powder coating to at least a portion of the coated first area of the round surface of the metal string, said powder coating including at least a plurality of particles of a low-friction material; and (c) curing the applied corrosion resistant liquid base coating and the powder coating at a designated cure temperature, said curing causing said plurality of particles of the low-friction material to migrate to above the corrosion resistant liquid base coating applied to the first area of the round surface of the metal string and bond together above the first area of the round surface of the metal string to form a low-friction top coat above the corrosion resistant liquid base coating applied to the first area of the round surface of the metal string.

2. The method of claim 1, wherein said metal string is selected from the group consisting of: a sports string configured to operate with a sporting equipment and a musical string configured to operate with a musical instrument.

3. The method of claim 2, wherein said musical string is a wound musical string.

4. The method of claim 3, which includes applying the corrosion resistant liquid base coating to at least one of: an inner surface of the wound musical string, an outer surface of the wound musical string and at least one interstice of the wound musical string.

5. The method of claim 4, which includes applying ultrasonic energy to cause the corrosion resistant liquid base coating to penetrate at least one of: the inner surface of the wound musical string, the outer surface of the wound musical string and the at least one interstice of the wound musical string.

6. The method of claim 1, wherein the powder coating includes a plurality of interspersed anti-microbial particles.

7. The method of claim 6, wherein the anti-microbial particles include at least one of the group consisting of silver particles, glass-silver particles, silver-ceramic particles and ceramic particles.

8. The method of claim 1, which includes applying the corrosion resistant liquid base coating and the powder coating to an entire outer surface of the metal string.

9. The method of claim 1, wherein the corrosion resistant liquid base coating comprises a pigment formulated to change from a first color to a second different color when heated above a color shifting temperature, the color shifting temperature being lower than the temperature at which the low-friction material substantially degrades.

10. The method of claim 1, wherein the applied corrosion resistant liquid base coating is three to six microns thick.

11. A method of manufacturing a coated sports string configured to operate with sporting equipment, said method comprising:

(a) applying a corrosion resistant liquid base coating to a first area of a round surface of a sports string;

(b) while the applied corrosion resistant liquid base coating is wet, applying a powder coating to at least a portion of the coated first area of the round surface of the sports string, said powder coating including at least a plurality of particles of a low-friction material; and (c) curing the applied corrosion resistant liquid base coating and the powder coating at a designated cure temperature, said curing causing said plurality of particles of the low-friction material to bond together above the first area of the round surface of the sports string to form a low-friction top coat above the corrosion resistant liquid base coating applied to the first area of the round surface of the sports string.

12. The method of claim 11, wherein the powder coating includes a plurality of interspersed anti-microbial particles.

13. The method of claim 12, wherein the anti-microbial particles include at least one of the group consisting of silver particles, glass-silver particles, silver-ceramic particles and ceramic particles.

14. The method of claim 11, further comprising applying the corrosion resistant liquid base coating and the powder coating to an entire outer surface of the sports string.

15. The method of claim 11, wherein the corrosion resistant liquid base coating comprises a pigment formulated to change from a first color to a second different color when heated above a color shifting temperature, the color shifting temperature being lower than the temperature at which the low-friction material substantially degrades.

16. The method of claim 11, wherein the applied corrosion resistant liquid base coating is three to six microns thick.

17. A method of manufacturing a coated metal musical string configured to operate with a musical instrument, said method comprising:

(a) applying a corrosion resistant liquid base coating to a first area of a round surface of a metal musical string;

(b) while the applied corrosion resistant liquid base coating is wet, applying a powder coating to at least a portion of the coated first area of the round surface of the metal musical string, said powder coating including at least a plurality of particles of a low-friction material and a plurality of anti-microbial particles; and (c) curing the applied corrosion resistant liquid base coating and the powder coating at a designated cure temperature, said curing causing said plurality of particles of the low-friction material to bond together above the first area of the round surface of the metal musical string to form a low-friction top coat above the corrosion resistant liquid base coating applied to the first area of the round surface of the metal musical string.

18. The method of claim 17, wherein said metal musical string is a wound musical string.

19. The method of claim 18, further comprising applying the corrosion resistant liquid base coating to at least one of: an inner surface of the wound musical string, an outer surface of the wound musical string and at least one interstice of the wound musical string.

20. The method of claim 19, further comprising applying ultrasonic energy to cause the corrosion resistant liquid base coating to penetrate at least one of: the inner surface of the wound musical string, the outer surface of the wound musical string and the at least one interstice of the wound musical string.

21. The method of claim 17, wherein the anti-microbial particles include at least one of the group consisting of silver particles, glass-silver particles, silver-ceramic particles and ceramic particles.

22. The method of claim 17, further comprising applying the corrosion resistant liquid base coating and the powder coating to an entire outer surface of the metal musical string.

23. The method of claim 17, wherein the corrosion resistant liquid base coating comprises a pigment formulated to change from a first color to a second different color when heated above a color shifting temperature, the color shifting temperature being lower than the temperature at which the low-friction material substantially degrades.

24. The method of claim 17, wherein the applied corrosion resistant liquid base coating is three to six microns thick.

* * * * *